US012270319B2

(12) United States Patent
Kumar et al.

(10) Patent No.: US 12,270,319 B2
(45) Date of Patent: Apr. 8, 2025

(54) SYSTEM AND A METHOD FOR GENERATING MECHANICAL POWER USING SUPER CRITICAL CARBON DIOXIDE

(71) Applicant: INDIAN INSTITUTE OF SCIENCE, Bangalore (IN)

(72) Inventors: Pramod Kumar, Bangalore (IN); Siddhant Karmarkar, Bangalore (IN)

(73) Assignee: INDIAN INSTITUTE OF SCIENCE, Bangalore (IN)

( * ) Notice: Subject to any disclaimer, the term of this patent is extended or adjusted under 35 U.S.C. 154(b) by 0 days.

(21) Appl. No.: 18/553,951

(22) PCT Filed: Apr. 5, 2022

(86) PCT No.: PCT/IB2022/053138

§ 371 (c)(1),
(2) Date: Oct. 4, 2023

(87) PCT Pub. No.: WO2022/214945

PCT Pub. Date: Oct. 13, 2022

(65) Prior Publication Data

US 2024/0209757 A1 Jun. 27, 2024

(30) Foreign Application Priority Data

Apr. 9, 2021 (IN) ..... 202141016852

(51) Int. Cl.
*F01K 25/10* (2006.01)
*F01K 7/32* (2006.01)

(52) U.S. Cl.
CPC ..... *F01K 25/103* (2013.01); *F01K 7/32* (2013.01)

(58) Field of Classification Search
CPC ..... F01K 25/103; F01K 7/32; F02G 1/044; F02B 41/06; F02B 33/22
See application file for complete search history.

(56) References Cited

U.S. PATENT DOCUMENTS

2009/0314005 A1* 12/2009 Messmer ..... F02F 1/4292 60/624
2017/0234266 A1 8/2017 Hwang et al.

FOREIGN PATENT DOCUMENTS

WO WO-2019028491 A1 * 2/2019 ..... F01K 23/06

OTHER PUBLICATIONS

International Search Report and Written Opinion for International Application No. PCT/IB2022/053138, dated Jul. 20, 2022, 7 pgs.
(Continued)

*Primary Examiner* — Loren C Edwards
(74) *Attorney, Agent, or Firm* — Foley & Lardner LLP

(57) ABSTRACT

A system for generating mechanical power using super critical carbon dioxide ($sCO_2$) is disclosed. The system includes at least one expansion cylinder (5) housing a first piston (5*a*) and at least one compression cylinder (6) housing a second piston (6*a*). A first heat exchanger (C) is fluidically connected to the compression cylinder (6) and the expansion cylinder (5), and a second heat exchanger (H) is fluidically connected to the compression cylinder (6) and the expansion cylinder (5). The first heat exchanger (C) cools the $CO_2$ received from the expansion cylinder (5), and the compression cylinder (6) pressurizes the $CO_2$ cooled by the first heat exchanger (C). The second heat exchanger (H) heats the $CO_2$ from the compression cylinder (6) and supplies to the expansion cylinder (5). The high temperature and high-pressure $CO_2$ drives the first piston (5*a*) housed inside the expansion cylinder (5) to generate mechanical energy.

8 Claims, 13 Drawing Sheets

(56) References Cited

OTHER PUBLICATIONS

Office Action issued in corresponding Indian Patent Application No. 202141016852 dated Jul. 20, 2022 (4 pages).
PCT International Preliminary Report on Patentability, dated Oct. 10, 2023, which includes a Translation of International Searching Authority, "Written Opinion," issued in connection with International Patent Application No. PCT/IB2022/053138, dated Jul. 20, 2022.

* cited by examiner

SYSTEM AND A METHOD FOR GENERATING MECHANICAL POWER USING SUPER CRITICAL CARBON DIOXIDE

CROSS REFERENCE TO RELATED APPLICATIONS

The present application claims priority under 35 U.S.C. § 371 to International Patent Application No. PCT/IB2022/053138, filed Apr. 5, 2022, which claims priority to and the benefit of Indian patent application No. 20/214,1016852, filed Apr. 9, 2021. The contents of these applications are hereby incorporated by reference in their entireties.

TECHNICAL FIELD

Present disclosure generally relates to a field of thermodynamics. Particularly, but not exclusively, the present disclosure relates to a system for generating mechanical power. Further embodiments of the disclosure disclose a twin cylinder reciprocating system using super critical carbon dioxide operable under Brayton cycle for generating mechanical power.

BACKGROUND OF THE INVENTION

Steam power plants are widely utilized for electricity generation. A steam power plant consists of a heat exchanger, steam turbine and generator, and other auxiliaries. The heat exchanger generates steam at high pressure and high temperature. The heat exchanger may generate steam by absorbing energy from a heat source. The steam turbine converts the heat energy of steam into mechanical energy.

With advancement in technologies, supercritical Carbondioxide Brayton cycles are considered promising replacement for existing steam power plants and are also a viable alternative to Organic Rankine Cycles (ORC's) for Waste Heat Recovery systems or bottoming cycles for gas turbines. In addition, attempts to use the s-$CO_2$ cycle in sodium-cooled fast reactors have also been reported. The compactness and single-phase operation make it attractive to a variety of heat sources. In this regard, numerous patents related to utilization and commercialization of s-$CO_2$ cycle for the exhaust/waste heat recovery application have been filed in the past. An attractive feature of s-$CO_2$ Brayton cycles is higher thermal efficiencies in excess of 30% even at a lower source temperature (820 K) which was not matched by a conventional sub-critical $CO_2$ or steam-based Rankine cycle even with a high source temperature of 978 K. Known industry players such as GE (USA), BH (Italy), Pratt & Whitney Rocketdyne (USA) and Electricite De France (France) are extensively researching on adaptation of s-$CO_2$ cycles for coal-based power generation.

Carbon dioxide when compressed to supercritical state has nearly two times the density (139 kg/$m^3$ at 500° C., 210 bar) compared to steam or air (87.4 kg/$m^3$ at 500° C., 210 bar for air). Also, the pressure ratio of a s-$CO_2$ Brayton is around 2.3 compared to steam which expands nearly 4200 times from 210 bar to 0.05 bar at the turbine exhaust resulting in large change in density of steam. As a result, the volumetric flow rates in a steam turbine are significantly higher, thus facilitating larger blade heights and turbine sizes. On the contrary the change in density of $CO_2$ across the turbine is very small leading to very small blade heights. Due to this very fact, s-$CO_2$ turbines at sub megawatt scale need to spin at very high rpms (50-100 k rpm) to produce adequate power at respectable isentropic efficiencies. Designing a sub mega s$CO_2$ turbomachinery has its own sets of challenges. To begin with the blade geometry is complex, often requiring intricate 3-D variable section profiles with very small aspect ratios and blade heights. A direct consequence of low blade heights is the very small hub diameters, leading to issues such as high-speed rotor dynamics, shaft seals and bearings etc. Most often the turbines spin at beyond the first critical speed, sometimes beyond second critical speed as well, thus posing severe constraints on both design and manufacturing. The turbomachinery has to be crafted with watchmaker's precision and dynamically balanced at operating speeds using expensive high-speed balancing machines. Consequently, the cost of a sub megawatt turbomachinery skyrockets thus making it commercially unviable.

The present disclosure is directed to overcome one or more limitations stated above, or any other limitation associated with the prior arts.

SUMMARY OF THE DISCLOSURE

One or more shortcomings of the conventional system or device are overcome, and additional advantages are provided through the provision of the method as claimed in the present disclosure.

Additional features and advantages are realized through the techniques of the present disclosure. Other embodiments and aspects of the disclosure are described in detail herein and are considered a part of the claimed disclosure.

In one non-limiting embodiment of the disclosure, a system for generating mechanical power using super critical carbon dioxide is disclosed. The system includes at least one expansion cylinder defining a first internal volume. The expansion cylinder houses a first piston connected to a crankshaft through a first connecting rod, where expansion cylinder is defined with one or more inlet ports and one or more outlet ports. At least one compression cylinder defining a second internal volume is provided. The compression cylinder houses a second piston connected to the crankshaft through a second connecting rod, where the at least one compression cylinder is defined with one or more inlet ports and one or more outlet ports. The first internal volume of the at least one expansion cylinder is greater than the second internal volume of the at least one compression cylinder. A first heat exchanger is fluidically connected to the inlet port of the at least one compression cylinder and the outlet port of the at least one expansion cylinder. A second heat exchanger is fluidically connected to the outlet port of the at least one compression cylinder and the inlet port of the at least one expansion cylinder. The first heat exchanger is configured to cool the $CO_2$ received from the outlet port of the at least one expansion cylinder, and the at least one compression cylinder pressurizes the $CO_2$ cooled by the first heat exchanger. The second heat exchanger is configured to heat the s$CO_2$ received from the outlet port of the at least one compression cylinder and supply the s$CO_2$ to the inlet port of the at least one expansion cylinder. The high temperature and high-pressure $CO_2$ drives the first piston housed inside the expansion cylinder downwards to generate mechanical energy in the at least one expansion cylinder.

In one non-limiting embodiment of the disclosure, a third heat exchanger fluidically connects the at least one compression cylinder to the first heat exchanger and the at least one expansion cylinder to the second heat exchanger.

In an embodiment of the disclosure, the inlet port of the at least one expansion cylinder is fluidically connected to a first end of the second heat exchanger and the outlet port of the expansion cylinder is fluidically connected to a first end of the third heat exchanger.

In an embodiment of the disclosure, the inlet port of the at least one compression cylinder is fluidically connected to a second end of the first heat exchanger and the outlet port of the at least one compression cylinder is fluidically connected to a second end of the third heat exchanger.

In an embodiment of the disclosure, the inlet and the outlet ports of the at least one expansion cylinder is provided with one or more inlet valves and one or more outlet valves.

In an embodiment of the disclosure, the inlet valve of at least one expansion cylinder opens when the first piston traverses down from a top dead center of the expansion cylinder.

In an embodiment of the disclosure, the inlet valve of the at least one expansion cylinder closes before the first piston is at a bottom dead center of the expansion cylinder.

In an embodiment of the disclosure, the outlet valve of the at least one expansion cylinder opens when the first piston traverses from the bottom dead center to the top dead center of the expansion cylinder.

In an embodiment of the disclosure, the outlet valve of the at least one expansion cylinder closes when the first piston is at a top dead center of the expansion cylinder.

In an embodiment of the disclosure, the inlet and the outlet ports of the at least one compression cylinder is provided with one or more inlet valves and outlet valves.

In an embodiment of the disclosure, the inlet valve of the at least one compression cylinder opens when the second piston traverses down from the top dead center of the compression cylinder.

In an embodiment of the disclosure, the inlet valve of the at least one compression cylinder closes when the second piston is at the bottom dead center of the compression cylinder.

In an embodiment of the disclosure, the outlet valve of the at least one compression cylinder opens after pressurizing the $CO_2$ and when the second piston traverses from the bottom dead center to the top dead center of the compression cylinder.

In an embodiment of the disclosure, the outlet valve of the at least one compression cylinder closes when the second piston reaches the top dead center of the compression cylinder.

In one non-limiting embodiment of the disclosure, a method of assembling a system for generating mechanical power using super critical carbon dioxide is disclosed. The method includes aspects of providing at least one expansion cylinder defining a first internal volume where, the expansion cylinder houses a first piston connected to a crankshaft through a first connecting rod. The expansion cylinder is defined with one or more inlet ports and one or more outlet ports. At least one compression cylinder is provided defining a second internal volume where, the compression cylinder houses a second piston connected to the crankshaft through a second connecting rod. The at least one compression cylinder is defined with one or more inlet ports and one or more outlet ports. The first internal volume of the at least one expansion cylinder is greater than the second internal volume of the compression cylinder. The method involves fluidically connecting a first heat exchanger to the inlet port of the at least one compression cylinder and the outlet port of the at least one expansion cylinder. The method further involves aspect of fluidically connecting a second heat exchanger to the outlet port of the at least one compression cylinder and the inlet port of the at least one expansion cylinder where, the first heat exchanger is configured to cool the $CO_2$ received from the outlet port of the at least one expansion cylinder, and the at least one compression cylinder pressurizes the $CO_2$ cooled by the first heat exchanger. The second heat exchanger is configured to heat the $sCO_2$ received from the outlet port of the at least one compression cylinder and supply the $sCO_2$ to the inlet port of the at least one expansion cylinder. The high temperature and high-pressure $CO_2$ drives the first piston housed inside the expansion cylinder downwards to generate mechanical energy in the at least one expansion cylinder.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE ACCOMPANYING FIGURES

The novel features and characteristic of the disclosure are set forth in the appended claims. The disclosure itself, however, as well as a preferred mode of use, further objectives, and advantages thereof, will best be understood by reference to the following detailed description of an illustrative embodiment when read in conjunction with the accompanying figures. One or more embodiments are now described, by way of example only, with reference to the accompanying figures wherein like reference numerals represent like elements and in which:

Figure 14:
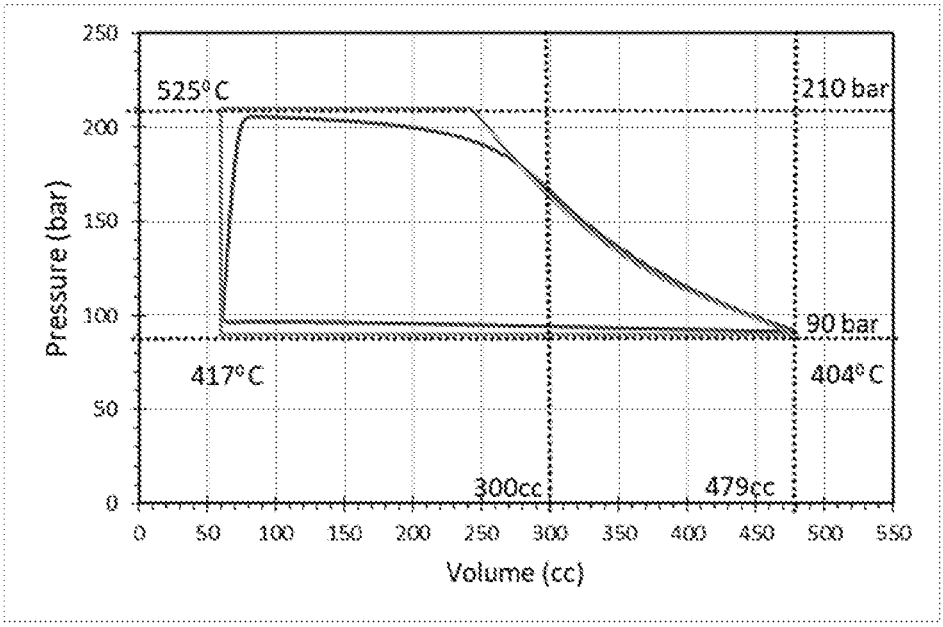
Figure 15:
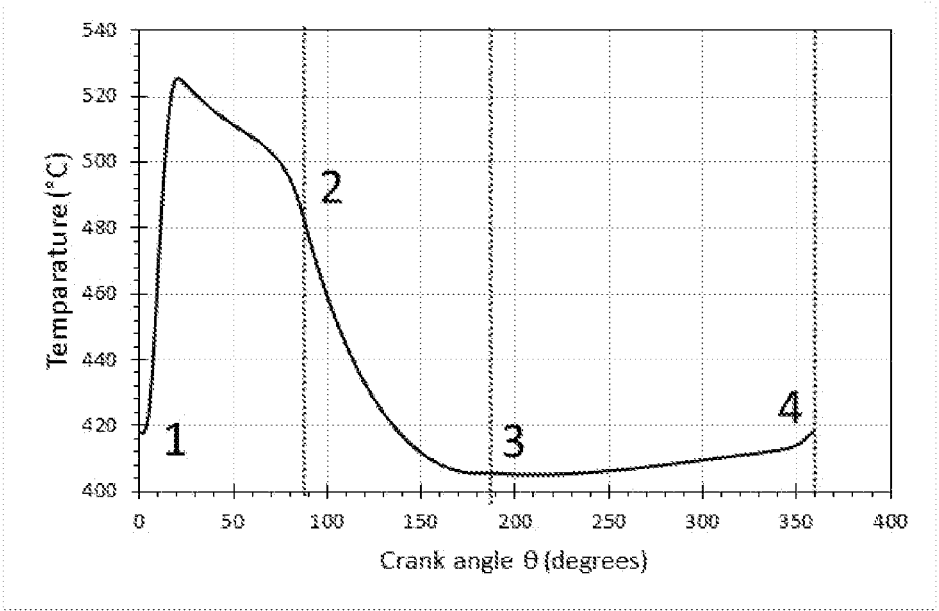
Figure 16:
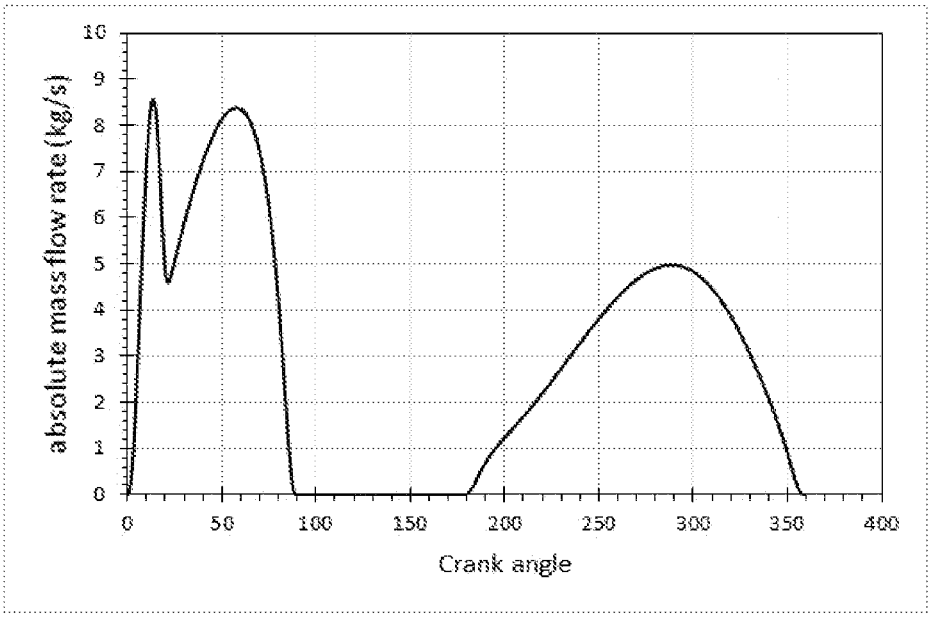

FIGS. 14 to 16 graphically show the summary of results for the expansion cylinder, in accordance with an embodiment of the present disclosure.

Figure 17:
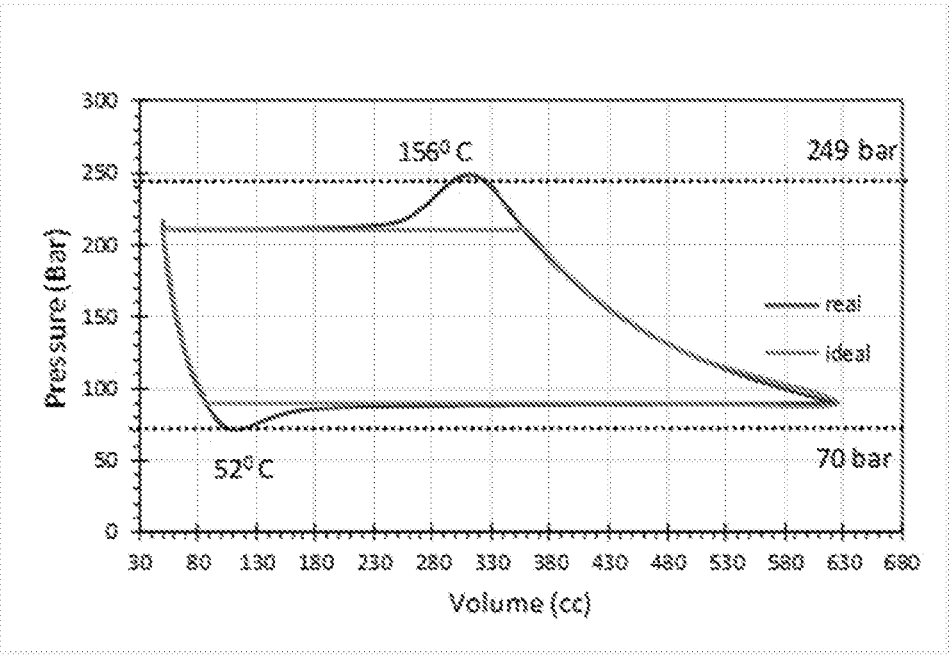
Figure 18:
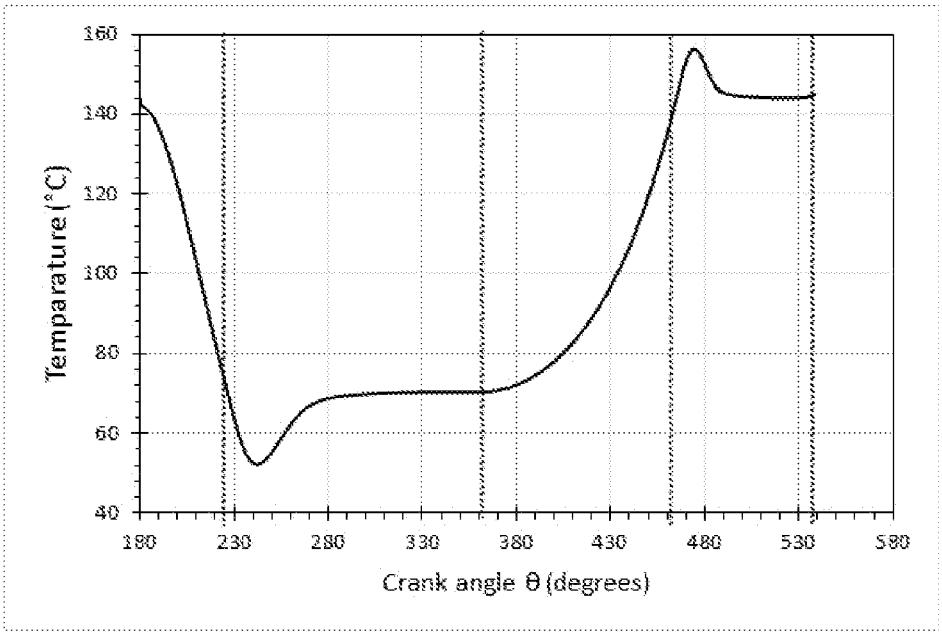
Figure 19:
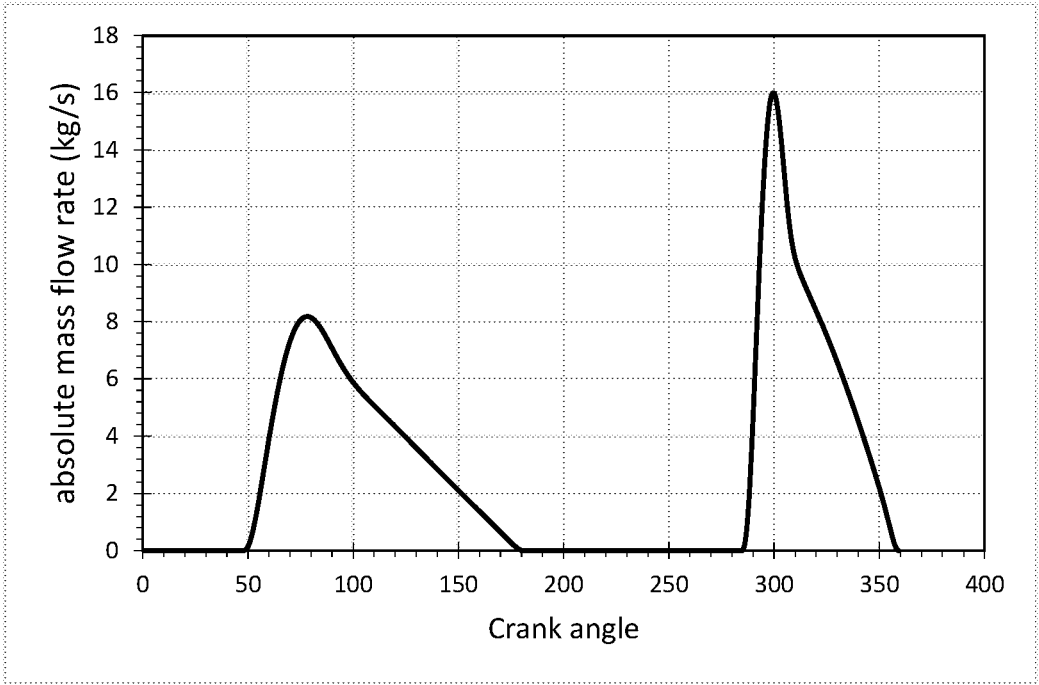

FIGS. 17 to 19 graphically show the summary of results for the compression cylinder, in accordance with an embodiment of the present disclosure.

The figure depicts embodiments of the disclosure for purposes of illustration only. One skilled in the art will readily recognize from the following description that alternative embodiments of the system for generating mechanical power using super critical carbon dioxide (sCO2) without departing from the principles of the disclosure described herein.

DETAILED DESCRIPTION

The foregoing has broadly outlined the features and technical advantages of the present disclosure in order that the description of the disclosure that follows may be better understood. Additional features and advantages of the disclosure will be described hereinafter which form the subject of the disclosure. It should be appreciated by those skilled in the art that the conception and specific embodiment disclosed may be readily utilized as a basis for modifying or designing other system for carrying out the same purposes of the present disclosure. It should also be realized by those skilled in the art that such equivalent constructions do not depart from the spirit and scope of the disclosure. The novel features which are believed to be characteristic of the disclosure, as to its organization, together with further objects and advantages will be better understood from the following description when considered in connection with the accompanying figures. It is to be expressly understood, however, that each of the figures is provided for the purpose of illustration and description only and is not intended as a definition of the limits of the present disclosure.

In the present document, the word "exemplary" is used herein to mean "serving as an example, instance, or illustration." Any embodiment or implementation of the present subject matter described herein as "exemplary" is not necessarily to be construed as preferred or advantageous over other embodiments.

While the disclosure is susceptible to various modifications and alternative forms, specific embodiment thereof has been shown by way of example in the drawings and will be described below. It should be understood, however that it is not intended to limit the disclosure to the particular forms disclosed, but on the contrary, the disclosure is to cover all modifications, equivalents, and alternatives falling within the scope of the disclosure.

The terms "comprises", "comprising", or any other variations thereof, are intended to cover a non-exclusive inclusion, such that a system that comprises a list of components does not include only those components but may include other components not expressly listed or inherent to such mechanism. In other words, one or more elements in the device or mechanism proceeded by "comprises . . . a" does not, without more constraints, preclude the existence of other elements or additional elements in the mechanism.

Embodiments of the present disclosure discloses a system for generating mechanical power using super critical carbon dioxide. High density of Carbon Dioxide (CO2) relative to steam/air results in very small volumetric flow rates in the compressor and turbine for comparable orders of power generation. This results in compressor and turbine sizes of the order of 0.1 m. The amount of flow turning possible in a turbine of such radii is thus restricted which results in smaller torque transmission. Similarly, the torque required to drive the compressor is reduced. For the same power consumed by the compressor or produced by the turbine, the shaft speed has to be increased up to 50-100 k rpm to compensate for the reduced torque. Designing a sub megawatt $sCO_2$ turbomachinery has its own sets of challenges. To begin with the blade geometry is complex, often requiring intricate 3-D variable section profiles with very small aspect ratios and blade heights. A direct consequence of low blade heights is the very small hub diameters, leading to issues such as high-speed rotor dynamics, shaft seals and bearings etc. Most often the turbines spin at speeds beyond the first critical speed, sometimes beyond second critical speed as well, thus posing severe constraints on both design and manufacturing. Consequently, the cost of a sub megawatt turbomachinery skyrockets thus making it commercially unviable.

Accordingly, the present disclosure discloses a system for generating mechanical power using super critical carbon dioxide. The system includes at least one expansion cylinder defining a first internal volume. The expansion cylinder houses a first piston connected to a crankshaft through a first connecting rod, where expansion cylinder is defined with one or more inlet ports and one or more outlet ports. At least one compression cylinder defining a second internal volume is provided in the system. The compression cylinder houses a second piston connected to the crankshaft through a second connecting rod, where the at least one compression cylinder is defined with one or more inlet ports and one or more outlet ports. The first internal volume of the at least one expansion cylinder is greater than the second internal volume of the at least one compression cylinder. A first heat exchanger is fluidically connected to the inlet port of the at least one compression cylinder and the outlet port of the at least one expansion cylinder. A second heat exchanger is fluidically connected to the outlet port of the at least one compression cylinder and the inlet port of the at least one expansion cylinder. The first heat exchanger is configured to cool the $CO_2$ received from the outlet port of the at least one expansion cylinder, and the at least one compression cylinder pressurizes the $CO_2$ cooled by the first heat exchanger. The second heat exchanger is configured to heat the $sCO_2$ received from the outlet port of the at least one compression cylinder and supply the $sCO_2$ to the inlet port of the at least one expansion cylinder.

The high temperature and high-pressure $CO_2$ drives the first piston housed inside the expansion cylinder downwards to generate mechanical energy in the at least one expansion cylinder.

Figure 1:
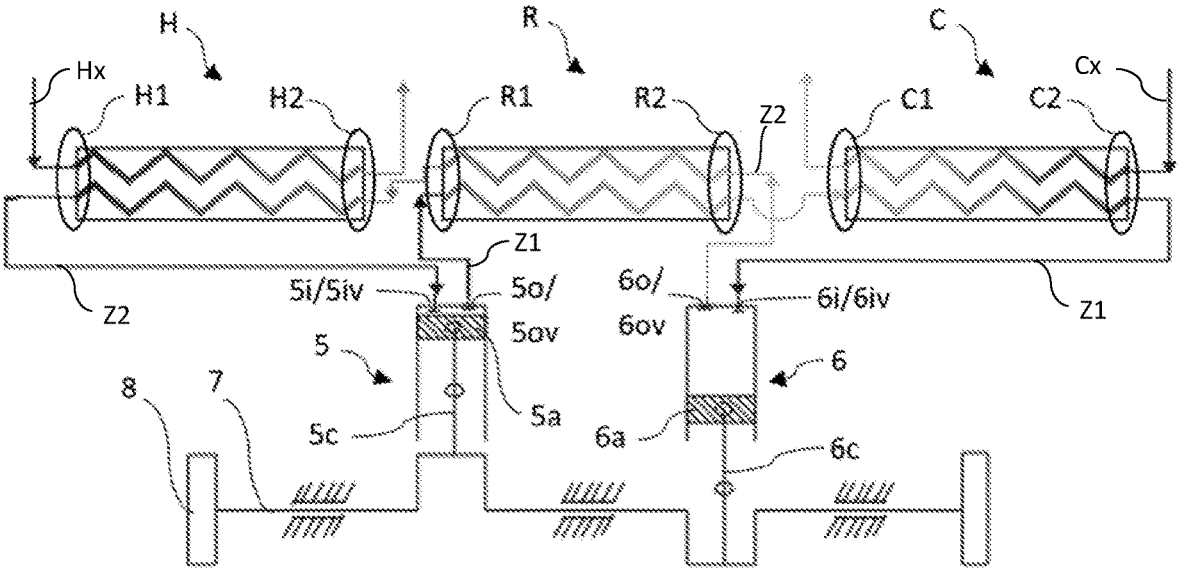
FIG. 1 is a schematic representation of a system for generating power using super critical carbon dioxide, in accordance with an embodiment of the present disclosure.
Figure 6:
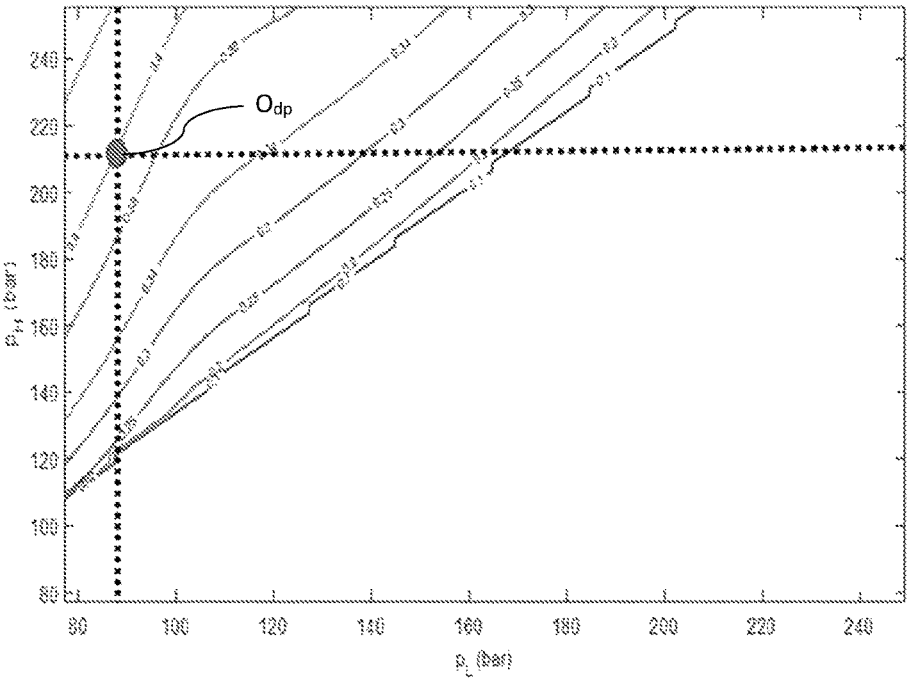
FIG. 6 is a graphical representation showing contours of cycle efficiency v/s high side and low side pressure, in accordance with an embodiment of the present disclosure.

The following paragraphs describe the present disclosure with reference to FIGS. 1 and 6.

The following detailed description is merely exemplary in nature and is not intended to limit application and uses. Furthermore, there is no intention to be bound by any theory presented in the preceding background or summary or the following detailed description. It is to be understood that the invention may assume various alternative orientations and step sequences, except where expressly specified to the contrary. It is also to be understood that the specific devices or components illustrated in the attached drawings and described in the following specification are simply exemplary embodiments of the inventive concepts defined in the appended claims. Hence, specific dimensions, directions or other physical characteristics relating to the embodiments that may be disclosed are not to be considered as limiting, unless the claims expressly state otherwise.

FIG. 1 is a schematic representation of a system (100) for generating power using super critical carbon dioxide ($sCO_2$). The system includes at least one expansion cylinder (5) and at least one compression cylinder (6) defining a first internal volume (V1) and a second internal volume (V2) respectively. The expansion cylinder (5) houses a first piston (5*a*) connected to a crankshaft (7) through a first connecting rod (5*c*). Further, the expansion cylinder (5) is defined with one or more inlet ports (5*i*) and one or more outlet ports (5*o*). The one or more inlet ports (5*i*) and one or more outlet ports (5*o*) of the expansion cylinder (5) are provided with an inlet valve (5*iv*) and an outlet valve (5*ov*). The compression cylinder (6) houses a second piston (6*a*) and is also connected to the crankshaft (7) through a second connecting rod (6*c*). The at least one compression cylinder (6) is defined with one or more inlet ports (6*i*) and one or more outlet ports (6*o*). The one or more inlet ports (6*i*) and one or more outlet ports (6*o*) of the compression cylinder (6) are provided with an inlet valve (6*iv*) and an outlet valve (6*ov*). In an embodiment, the first internal volume (V1) of the at least one expansion cylinder (5) is greater than the second internal volume (V2) of the at least one compression cylinder (6). The system (100) further includes a first heat exchanger (C), a second heat exchanger (H) and a third heat exchanger (R). The first heat exchanger (C) may be defined by first end (C1) and a second end (C2). The first heat exchanger (C) may house a first $CO_2$ flow line and a coolant flow line (Cx). A liquid or gas at a temperature lower that the temperature of the $CO_2$ flowing through the first heat exchanger (C) may be circulated though the coolant flow line (Cx). The first heat exchanger (C) may be cooler and may reduce the temperature of the $CO_2$ flowing through the first $CO_2$ line (Z1). The first $CO_2$ flow line (Z1) may enter the first heat exchanger (C) through the first end (C1) and may exit the first heat exchanger (C) through the second end (C2). The first $CO_2$ flow line (Z1) that exits the first exchanger (C) may be fluidically coupled to the inlet port (6*i*) of the compression cylinder (6). Further, the outlet port (6*o*) of the compression cylinder (6) may be fluidically coupled to a second $CO_2$ flow line (Z2). The second $CO_2$ flow line (Z2) from the outlet port (6*o*) of the compression cylinder (6) may enter the third heat exchanger (R) through a second end (R2) of the third heat exchanger (R). The second $CO_2$ flow line (Z2) may exit the third heat exchanger (R) through a first end (R1) of the third heat exchanger (R) and may further enter the second heat exchanger (H) though a second end (H2) of the second heat exchanger (H2). The second $CO_2$ flow line (Z2) may exit the second heat exchanger (H) through a first end (H1) of the second heat exchanger (H) and may fluidically be coupled to the inlet port (5*i*) of the expansion cylinder (5). Further, the outlet port (5*o*) of the expansion cylinder (5) may be fluidically coupled to the first $CO_2$ flow line (Z1) and the first $CO_2$ flow line (Z1) may extend from the outlet port (5*o*) of the expansion cylinder (5) into the third heat exchanger (R) through the first end (R1) of the third heat exchanger (R1). The first $CO_2$ flow line (Z1) may further exit the third heat exchanger (R) through the second end (R2) of the third heat exchanger (R2) and may enter the first heat exchanger (C). Thus, the third heat exchanger (R) houses both the first $CO_2$ flow line (Z1) extending from the outlet port (6*o*) of the compression cylinder (6) to the second heat exchanger (H) and the second $CO_2$ flow line (Z2) extending from the outlet port (5*o*) of the expansion cylinder (5) into the third heat exchanger (C). The second heat exchanger (H) may house a heating line (Hx) through which a fluid at high temperatures may be circulated. The heating line (Hx) may be configured to transfer heat to the $CO_2$ flowing in the second $CO_2$ flow line (Z2) of the second heat exchanger (H). For example, the heating line (Hx) may extend from a heating source such as but not limiting to reactor for example chemical reactor. The heating line may be filled with sodium which absorbs heat from the reactor during the fission reaction and this heat from the sodium may be transferred to the $CO_2$ flowing in the second $CO_2$ flow line (Z2) of the second heat exchanger (H). The above description of coupling the heating line (Hx) from the reactor to the second heat exchanger (H) is merely exemplary in nature and is not intended to limit application and uses. For instance, the heating line (Hx) from an Ocean thermal energy conversion plant or any other energy generating source may be coupled to the second heat exchanger (H) to heat the $CO_2$ in the second $CO_2$ flow line (Z2). Consequently, the second heat exchanger (H) may act as a heater for heating the $CO_2$ flowing through the second $CO_2$ flow line (Z2). Further, the third heat exchanger (R) may act as a recuperator for salvaging the heat energy from the $CO_2$ flowing out of the expansion cylinder (5) to the first heat exchanger (C) through the first $CO_2$ flow line (Z1). The high temperature spent $CO_2$ leaving the expansion cylinder (5) through the first $CO_2$ flow line (Z1) may transfer heat to the $CO_2$ flowing out of the compression cylinder (6) through the second $CO_2$ flow line (Z2).

In an embodiment, the compression cylinder (6), the expansion cylinder (5), the first heat exchanger (C) and the second heat exchanger (H) may be coupled together without the third heat exchanger (R). For instance, the second $CO_2$ line (Z2) extending from the outlet port (6*o*) of the compression cylinder (6) may directly be coupled to the second end (H2) of the second heat exchanger (H). Further, the first $CO_2$ line (Z1) extending from the outlet port (5*o*) of the expansion cylinder (5) may directly be coupled to the first end (C1) of the first heat exchanger (C). The third heat exchanger (R) may completely be abandoned in the above configuration since, the third heat exchanger (R) is a recuperator. The $CO_2$ may be directly heated in the second heat exchanger (H) without making use of the second heat exchanger (R) for salvaging the heat from the spent $CO_2$ of the expansion cylinder (5).

The above configuration of the first internal volume (V1) of the at least one expansion cylinder (5) being greater than the second internal volume (V2) of the at least one compression cylinder (6) becomes critical for the operation of the system (100) since, there exists significant difference in density of the $CO_2$ at different temperatures. For instance, $CO_2$ occupies lesser volume at lower temperatures, whereas $CO_2$ at high temperatures occupies large volume of the cylinder. The difference in volume occupied by $CO_2$ at lower and higher operational temperatures varies drastically to an extent that the usage of a single cylinder for compression and expansion of $CO_2$ is not feasible. Consequently, two different cylinders i.e., compression cylinder (6) and expansion cylinder (5) are employed. Further, the first internal volume (V1) of the expansion cylinder is configured to be greater than the second internal volume (V2) of the at least one compression cylinder (6) for accommodating the increase in volume of $CO_2$ during higher operational temperatures.

Figure 2:
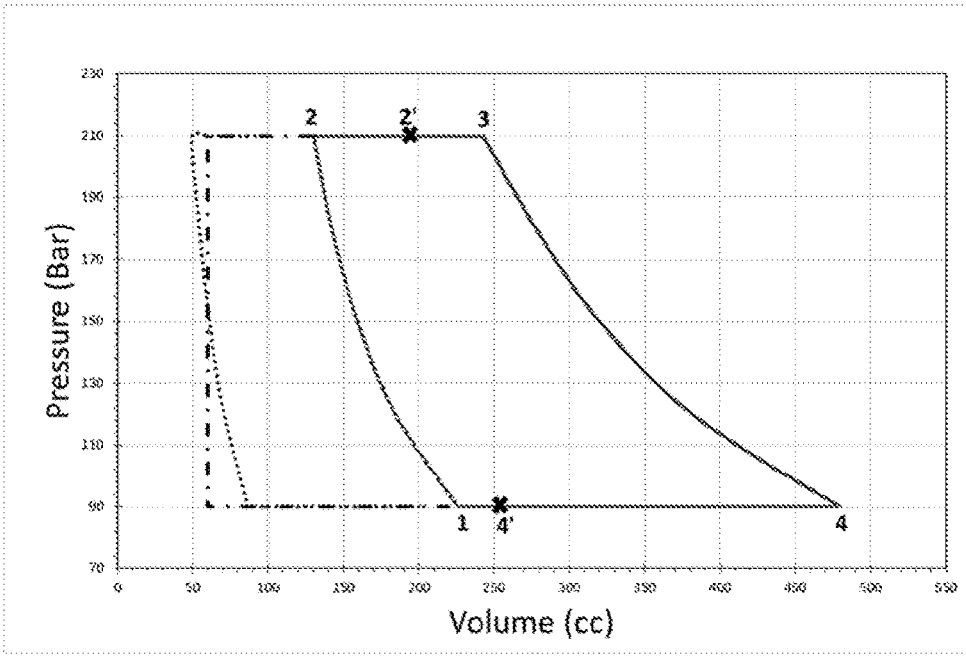
FIG. 2 illustrates a thermodynamic Brayton cycle of the system of FIG. 1, in accordance with an embodiment of the present disclosure.
Figure 3:
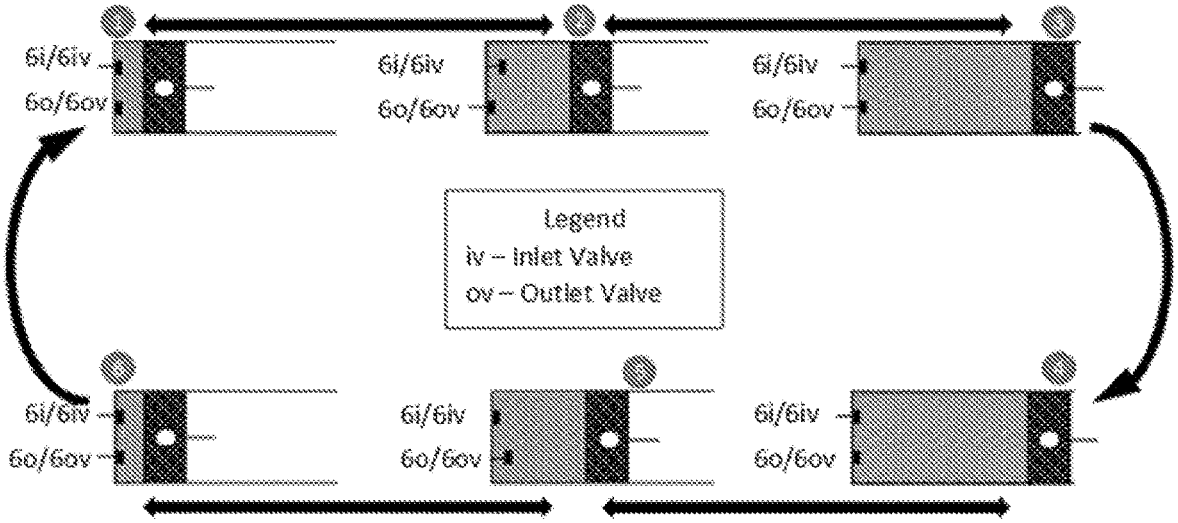
FIG. 3 is a schematic representation of the working of compressor in the system of FIG. 1, in accordance with an embodiment of the present disclosure.
Figure 4:
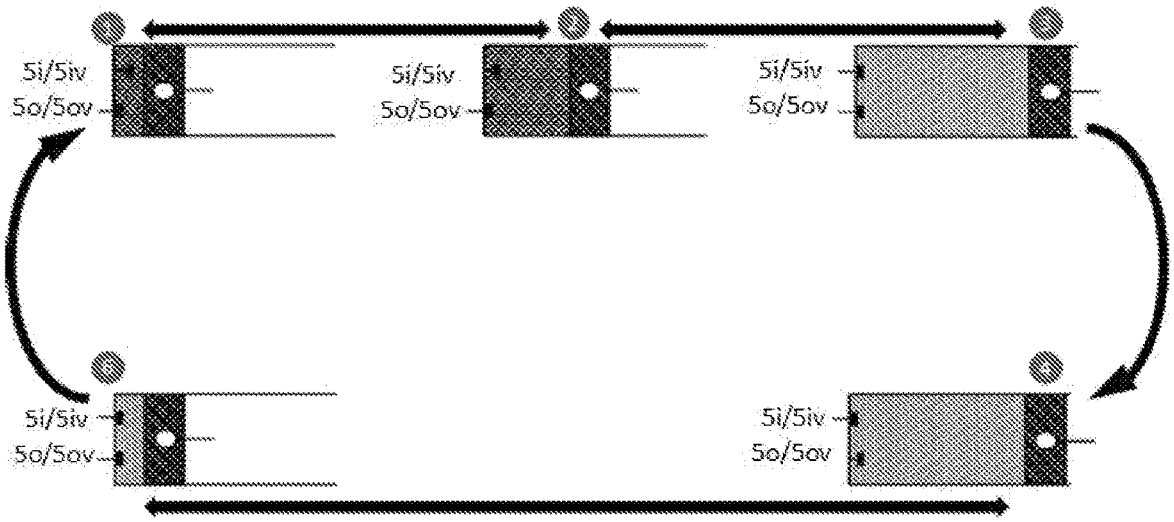
FIG. 4 is a schematic representation of the working of expander in the system of FIG. 1, in accordance with an embodiment of the present disclosure.
Figure 5:
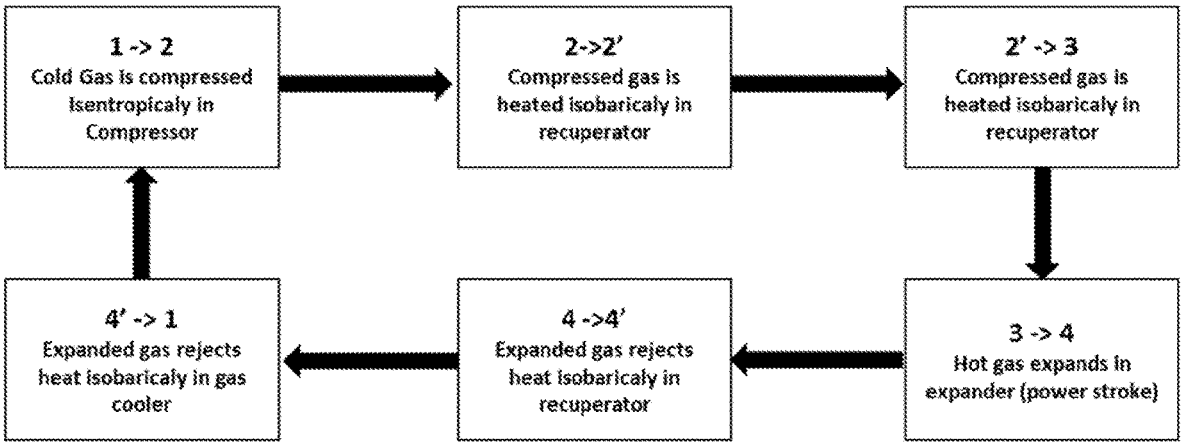
FIG. 5 is a flowchart of the method of generating power from the system illustrated in FIG. 1, in accordance with an embodiment of the present disclosure.

The working of the system (100) to generate mechanical power is explained in detail below. FIG. 2 illustrates a thermodynamic Brayton cycle of the system (100). FIG. 3 and FIG. 4 are a schematic representation of the working of compression cylinder (6) and the expansion cylinder (6) respectively. It is to be noted that a person skilled in the art would be motivated from the present disclosure to modify various features of system or method, without departing from the scope of the disclosure. Therefore, such modifications are considered to be part of the disclosure. Accordingly, the drawings show only those specific details that are pertinent to understand the embodiments of the present disclosure, so as not to obscure the disclosure with details that will be readily apparent to those of ordinary skilled in the art having benefit of the description herein. Also, the system of the present disclosure may be employed in any kind of power plants including coal-fired power plants, geothermal power plants, diesel power plants, and the like. However, complete power plant with the system (100) of the present disclosure is not illustrated in the drawings of the disclosure is for the purpose of simplicity. FIG. 5 is a flowchart of the method of generating power from the system (100) of the present disclosure. The supercritical $CO_2$ in the first $CO_2$ flow line (Z1) may initially enter the compression cylinder (6) through the inlet valve (6*iv*) of the inlet port (6*i*). The state of the $CO_2$ entering the compression cylinder (6) may be at a low pressure as depicted by point 1 of FIG. 2. The working of the compression cylinder (6) is explained with greater detail with reference to the FIGS. 2 and 3 below. As seen from sub-Figs of 1 and 3 of the FIG. 3, the inlet valve (6*iv*) of the compression cylinder (6) initially opens and the $CO_2$ fills inside the second internal volume (V2). The momentum in the flywheel (8) from a previous power stroke enables the movement of the second piston (6*a*) from the top dead center (TDC) to the bottom dead center (BDC) of the compression cylinder (6). As the second piston (6*a*) traverses from the TDC to the BDC, the inlet valve (6*iv*) of the compression cylinder (6) remains open and the $CO_2$ fills up the second internal volume (V2) of the compression cylinder (6). As seen from the sub-3 FIG. 3, the inlet valve (6*iv*) of the compression cylinder (6) closes when the second piston (6*a*) reaches the BDC. Further, the second piston (6*a*) begins to traverse from the BDC to the TDC after the intake stroke and the compression stroke in the compression cylinder begins. The momentum in the flywheel (8) from the power stroke of the expansion cylinder (5) enables the movement of the second piston (6*a*) from the BDC to the TDC. As the piston traverses from BDC to TDC, the $CO_2$ inside the second internal volume (V2) of the compression cylinder (6) is compressed. The specific volume of the $CO_2$ decreases as the $CO_2$ is pressurized in the compression cylinder (6). The pressure of the $CO_2$ inside the compression cylinder (6) also increases consequently. This reduction in volume and increase in pressure of $CO_2$ inside the compression cylinder (6) during the compression stroke is depicted by the curve between the points 1 and 2 in the graph of FIG. 2. The $CO_2$ will attain maximum pressure and minimum specific volume or highly dense at the end of the compression stroke inside the compression cylinder (6). This highly dense and pressurized $CO_2$ exits the compression cylinder (6) during an exhaust stroke of the compression cylinder (6) where the exhaust valve (6*ev*) opens as the second piston (6*a*) traverses from the BDC to the TDC. The dense and pressurized $CO_2$ enters the into the second $CO_2$ flow line (Z2) that is fluidically coupled to the outlet port (6*o*) of the compression cylinder (6). The highly dense and pressurized $CO_2$ now enters the third heat exchanger (R) through the second end (R2) of the third heat exchanger (R). The $CO_2$ from the compression cylinder (6) flowing through the second $CO_2$ flow line (Z2) is partially heated in the third heat exchanger (R) by the spent $CO_2$ flowing through the first $CO_2$ flow line (Z1). The partial increase in temperature of the $CO_2$ increases the overall volume of $CO_2$ in the second $CO_2$ flow line (Z2). This increase in volume of $CO_2$ in the second $CO_2$ flow line (Z2) due to the heat absorbed in the third heat exchanger (R) is depicted by the curve between the points 2 to 2' in the FIG. 2. The $CO_2$ further enters the second heat exchanger (H) through the second $CO_2$ flow line (Z2) from the third heat exchanger (R). The heating line (Hx) inside the second heat exchanger (H) further heats the $CO_2$ flowing through the second $CO_2$ flow line (Z2) to higher temperatures. Consequently, the volume of the $CO_2$ in the second $CO_2$ flow line (Z2) along the second heat exchanger (H) section further increases. This increase in volume of $CO_2$ in the second $CO_2$ flow line (Z2) due to the heat absorbed in the second heat exchanger (H) is depicted by the curve between the points 2' to 3 in the FIG. 2. The pressure during the act of circulating the $CO_2$ in the second $CO_2$ flow line (Z2) through the third and the second heat exchanger (R and H) remains the same, ideally with negligible reduction in a real scenario. The high pressure and high temperature $CO_2$ flowing out of the second heat exchanger (H) is circulated to the inlet port (5*i*) of the compression cylinder (5).

The working of the compression cylinder (6) is explained with greater detail with reference to the FIGS. 2 and 3 below. As seen from sub-Figs of 1 and 2 of the FIG. 3, the inlet valve (6*iv*) of the compression cylinder (6) initially opens and the high pressure and high temperature $CO_2$ is inlet into the expansion cylinder (5). As the pressurized $CO_2$ begins to expand inside the expansion cylinder (5), the first piston (5*a*) is forced from the TDC to the BDC. This step is known as the expansion stroke or the power stroke. This linear movement of the first piston (5*a*) being forced from the TDC to the BDC inside the expansion cylinder (5) is translated to a rotary motion of the crankshaft (7) through the first connecting rod (5*c*). As the pressurized $CO_2$ expands inside the expansion cylinder (5), the pressure drops, and the volume of the $CO_2$ increases drastically. This increase in volume of $CO_2$ and decrease in pressure is depicted by the curve between the points 3 to 4 in the FIG. 2. The momentum generated in the flywheel (8) during the power stroke would also drive the first piston (5*a*) from the BDC to the TDC of the expansion cylinder (5). The rotational momentum of the flywheel (8) will also facilitate the rotation of the second piston (6*a*) inside the compression cylinder (C). The portion of the crankshaft (7) coupled to the first connecting rod (5*c*) of the expansion cylinder (5) is offset by 180 degrees with respect to the portion of the crankshaft (7) coupled to the second connecting rod (6*c*) of the compression cylinder (6). The crankshaft (7) is thus configured such that, when the position of the first piston (5*a*) is at the TDC of the expansion cylinder (5), the second piston (6*a*) lies at the BDC of the compression cylinder (6). The above configuration ensures that the rotational momentum of the flywheel (8) generated during the power stroke is also efficiently utilized for engaging the second piston (6*a*) in the compression cylinder (6). Further, as the first piston (5*a*) traverses from the BDC to the TDC, the outlet valve (5*ov*) in the outlet port (5*o*) opens and the exhaust stroke begins. After the power stroke, the spent $CO_2$ is pushed out of the expansion cylinder (5) into the first $CO_2$ fluid line (Z1) that is fluidically coupled to the outlet port (5*o*) of the expansion cylinder (5). Though the spent $CO_2$ from the outlet port (5*o*) of the expansion cylinder (5) is at lower pressure, the temperature of the $CO_2$ may have slightly reduced but may be significant enough to be recouped in the recuperator or the third heat exchanger (R). The spent $CO_2$ in the first $CO_2$ fluid line (Z1) enters the third heat exchanger (R) through the first end (R1) of the third heat exchanger (R). The heat from the $CO_2$ in the first $CO_2$ fluid line (Z1) is absorbed by the $CO_2$ in the second $CO_2$ fluid line (Z2) at a significantly lower temperature. Consequently, the density of the $CO_2$ in the first $CO_2$ fluid line (Z1) increases and the volume of the $CO_2$ in the first $CO_2$ fluid line (Z1) reduces due to drop in temperature. This decrease in volume of $CO_2$ is depicted by the curve between the points 4 to 4' in the FIG. 2. Further, the $CO_2$ from the third heat exchanger (R) in the first $CO_2$ flow line (Z1), flows into the first heat exchanger (C). The first heat exchanger (C) acts as a cooler and the liquid or gas circulated through the cooling line (Cx) absorbs heat from the $CO_2$ in the first $CO_2$ fluid line (Z1). The liquid circulated through the cooling line (Cx) may be of a significantly lower temperature than that of the $CO_2$ flowing through the first heat exchanger (C) in the first $CO_2$ fluid line (Z1). As the temperature of the $CO_2$ drops after passing through the first heat exchanger (C), the volume of the $CO_2$ in the first $CO_2$ fluid line (Z1) also reduces significantly. This decrease in volume of $CO_2$ is depicted by the curve between the points 4' to 1 in the FIG. 2. The above process may be cyclic and may be repeated for generating power. The flywheel (8) may be coupled to a generator or any other form of power converting source known in the art.

Example

Further embodiments of the present disclosure will be now described with a working example of the system (100). FIG. 6 illustrates contours of cycle efficiency vs high side and low side pressure with an optimal design point ($O_{dc}$). A sample design for a 100-kW power block is described below. The optimal design point ($O_{dc}$) from the contour plot, of the low side pressure for a target power of 100-kW is fixed at 90 bar. Further it is evident that the high side pressure must be 210 bar for maximum efficiency. High side temperature is set at 500° C. and low side at 70° C. With the above constraints on high side and low side states, ideal cycles for the compression and expansion cylinders (6 and 5) can be generated for the target power of 100-kW from thermodynamic considerations. The below Table 1 lists the operating conditions for a 100-kW power block. A detail of the calculations and the procedure is shown subsequently.

TABLE 1

System for generating mechanical power of 100 kW using super critical carbon dioxide

| Parameter | Value |
|---|---|
| Operating Speed | 3000 (RPM) |
| High Side Pressure | 210 (Bar) |
| Low Side Pressure | 90 (Bar) |
| High Side Temperature | 500° C. |
| Low Side Temperature | 70° C. |

Figure 7:
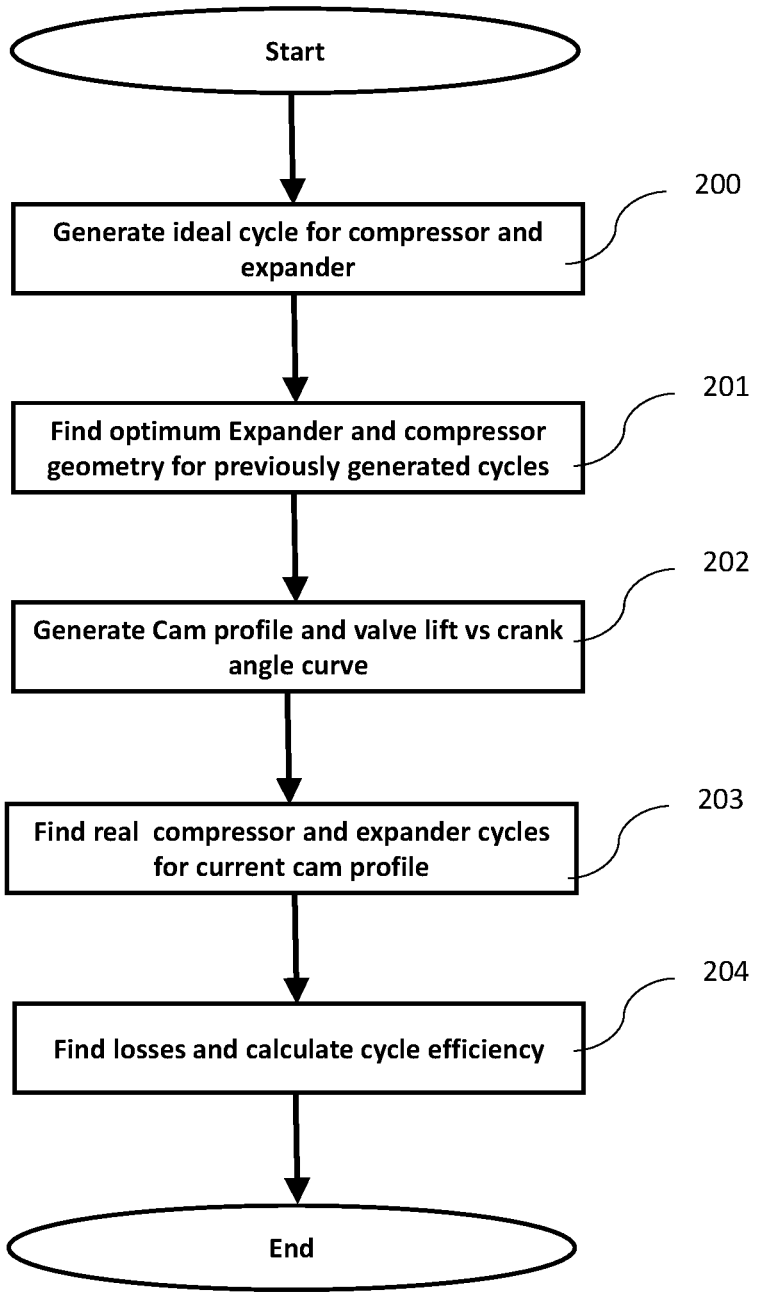
FIG. 7 illustrates a flowchart for designing the compression and expansion cylinders of the system of FIG. 1, in accordance with an embodiment of the present disclosure.
Figure 8:
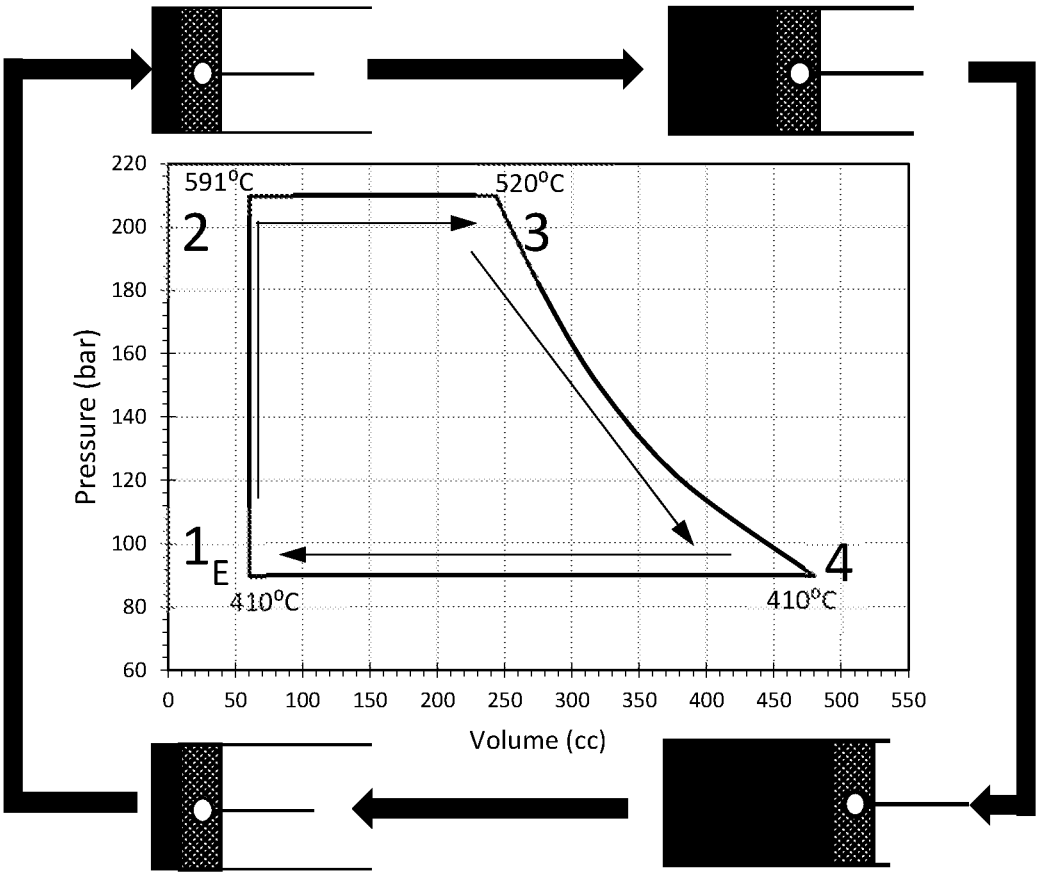
FIG. 8 is a graphical representation showing the pressure-volume diagram of the expansion cylinder, in accordance with an embodiment of the present disclosure.
Figure 9:
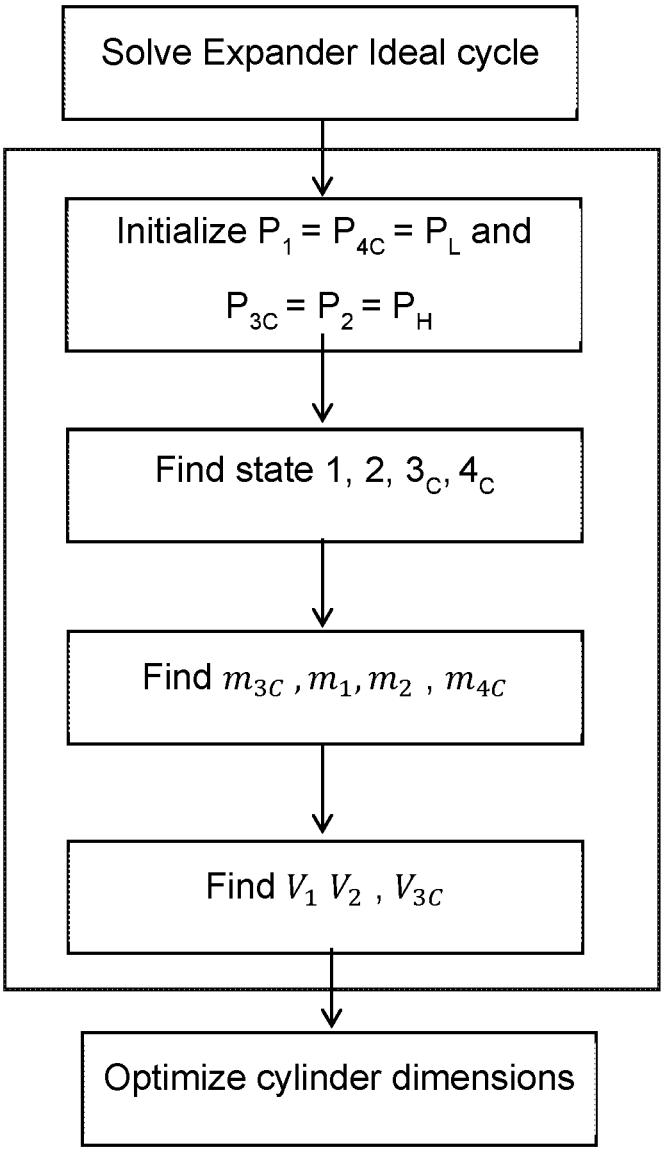
FIG. 9 is a flowchart for the ideal cycle analysis of the expansion cylinder, in accordance with an embodiment of the present disclosure.

FIG. 7 illustrates a flowchart of designing the system (100) and FIG. 8 illustrates the pressure-volume diagram of the expansion cylinder (5). As seen from FIG. 8, the pressure and volume are 60 cc and 90 bar after the exhaust stroke in the expansion cylinder (5) as depicted at point $\mathbf{1}_E$ in the FIG. 7. Initially, a clearance volume of 50 cc is assumed and a mass flow rate of 1.5 kg/s may be assumed. The pressure and volume at point $\mathbf{1}_E$ may already be known. Any temperature value may initially be assumed at point $\mathbf{1}_E$. Further, the above assumed parameters of the temperature and mass flow rate along with the known temperature at point $\mathbf{1}_E$ may be substituted to the below equation (2) to derive the temperature at the point $\mathbf{2}_E$ in the FIG. 8. Further, using the determined temperature at point $\mathbf{2}_E$ the temperature at point 3 may be determined by substituting the above assumed temperature and the above variables in the below equation number 1 and mass conservation. Further, by means of an isentropic expansion, the temperature at point 4 is determined. If the firstly assumed temperature at point 1 is correct, then the temperature determined at the point 4 of the graph would correspond to the temperature at the point 1 of the graph. If the temperature determined at point 4 is different from the temperature assumed at point 1 in the graph, then the assumed value of temperature at point 1 is updated or varied accordingly. The above process of the determining the temperature at point $\mathbf{2}_E$, 3 and 4 is conducted again and the temperature determined at the point 4 is again compared with the temperature assumed at point 1. If the values of temperature determined at point 4 still does not match the value of temperature assumed at point 1, then the temperature at point 1 is re-assumed and the whole process is re-iterated till the temperature determined corresponds to the value of temperature assumed at point 1. The mass in cylinder at this particular temperature where the temperature determined at point 4 corresponds to the value of temperature assumed at point 1, is recorded. With further reference to the flowchart from FIG. 9, the pressure at point 1 ($P_1$) is equal to the pressure at point 4 ($P_{4C}$) in the graph of FIG. 8 and this pressure is defined as the low side pressure ($P_L$) initially assumed. Further, the pressure at point 3 ($P_3$) and the pressure at point 2 ($P_2$) is equal and is defined as the high side pressure ($P_H$). Based on the recorded mass in cylinder at points 1, 2, 3, 4 of the graph in FIG. 8, and the pressure $P_1$, $P_2$, $P_3$, $P_4$, the corresponding volumes of the cylinder at the point 1, 2, 3 and 4 of the graph in FIG. 8 is determined. This swept volume is function $$\dot{q}_{cv} + \dot{m}_i h_i = \dot{W}_{cv} + \frac{dE_{C1}}{dt} \tag{1}$$

We assume that state two is reached from one much faster than movement of piston.

Pressure at state 2 is known to be 210 Bar. Integrating (1) we arrive at $$\frac{V_{1E}}{v_{2E}} u_{2E} - \left(\frac{V_{1E}}{v_{2E}} - \frac{V_{1E}}{v_{1E}}\right) h_i = \frac{V_{1E}}{v_{1E}} u_{1E} \tag{2}$$

of bore diameter and stroke length. Using the determined volume at points 1, 2, 3 and 4, the bore diameter of the expansion cylinder (5) may be calculated.

TABLE 2

Operating parameters and dimensions of the expansion cylinder

| | |
|---|---|
| Operating frequency | 50 Hz |
| Target power | 100 kW |
| Mass per cycle | 29 gm |
| Mass flow rate | 1.49 kg/s |
| Expander swept volume | 419 cc |
| Expander clearance volume | 60 cc |
| Compressor swept volume | 180 cc |
| Compressor Clearance volume | 50 cc |

Figure 10:
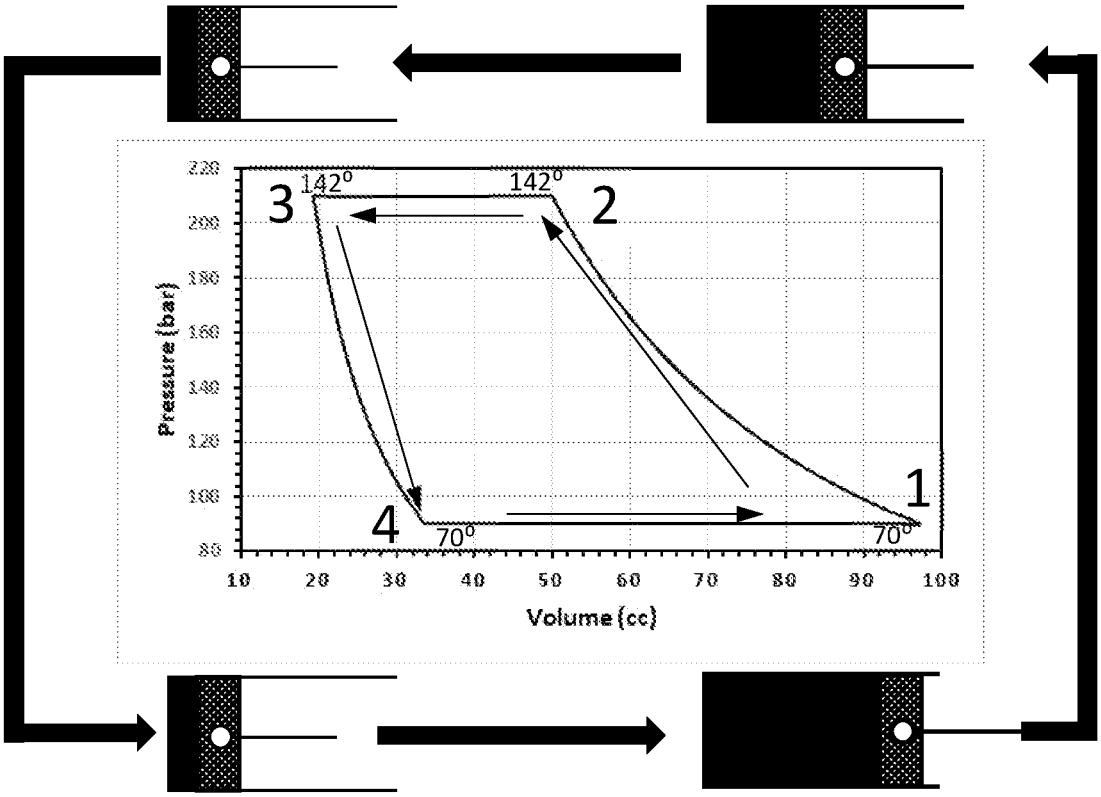
FIG. 10 is a graphical representation showing the pressure-volume diagram of the compression cylinder, in accordance with an embodiment of the present disclosure.
Figure 11:
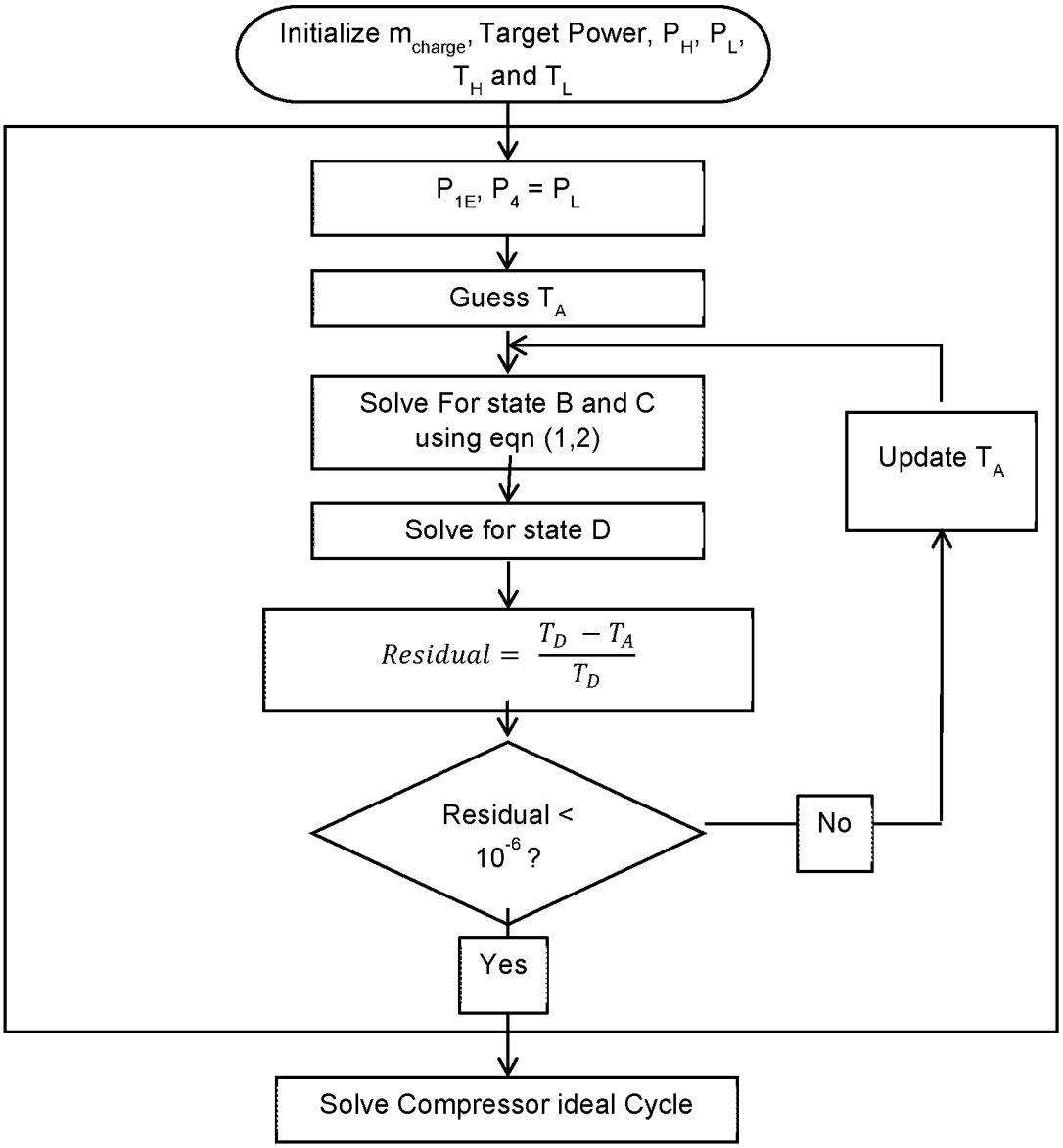
FIG. 11 is a flowchart for the ideal cycle analysis of the compression cylinder, in accordance with an embodiment of the present disclosure.

FIG. 10 illustrates the pressure-volume diagram of the compression cylinder (6). The pressure at point 2 is equal to the pressure at point 3 which may be considered as the high side pressure and the pressure at point 1 is equal to the pressure at point 4 which may be considered as the low side pressure. The temperature at points 1, 2, 3 and 4 are also determined based on the known pressures at point 1, 2, 3 and 4 respectively of the graph in FIG. 10. Initially, the cylinder clearance volume and the mass of inlet charge may be assumed at the point 3 of the graph in the FIG. 10. Further, the volume at each of the points of 1, 2, 3 and 4 may be determined based on the corresponding values of pressure and temperature. Initially, a clearance volume of 50 cc is assumed and a mass flow rate of 1.5 kg/s may be assumed. Pressure and Temperature at point 4 is already known as the low side pressure and temperature. The pressure at point 3 is already known as the high side pressure. Thus accordingly, the temperature at point 3 and pressure at point 4 can be found. and temperature at point 3 is already assumed such that the pressure and temperature after isentropic expansion to point 4 is equal to the low side pressure and temperature. Similarly, the state at point 1 is the same as point 4 and hence volume at point 1 can be found by using the assumed average mass flow rate. Further, Pressure, Temperature and Volume at point 2 can be found by considering an isentropic compression to high side pressure from point 1.

State 1, State $\mathbf{4}_C$ and $P_{3C}$ are known from initial assumptions. $V_{3C}$ is clearance volume of the compressor and is known.

State 2 and $\mathbf{3}_C$ can be found by considering isentropic compression and expansion from 1 and $\mathbf{4}_C$, respectively.

$$m_{3C} = \frac{V_{4C}}{v_{4C}} = m_{4C} \tag{5}$$

$$m_1 = m_{4C} + m_{charge} = m_2 = \frac{V_1}{v_1} = \frac{V_2}{v_2} \tag{6}$$

Thus, the ideal cycle for the compression cylinder (6) and the expansion cylinder (5) are generated in the step 200 of FIG. 7.

| Symbol | Description |
|---|---|
| E | Energy |
| $\dot{W}$ | Rate of work done |
| $\dot{q}$ | Rate of heat transfer |
| $\dot{m}$ | Rate of mass (entering or leaving as per the subscript) |
| H | Specific enthalpy |
| V | Volume |
| v | Specific volume |
| m | Mass |
| | Subscripts |
| 1E, 2E, 3, 4 | Refers to "at this point in the diagrams" |
| Charge | Amount of fresh mass used in one cycle |
| i | Inlet - entering the CV |
| e | Exhaust - leaving the CV |
| cv | Control Volume |

Further, based on the determined ideal cycle values, the optimum expansion and compression cylinder (5 and 6) geometries may be generated in the below manner (step 201 from FIG. 7). As described by Patton's equation (number 7 and 8), friction losses in the piston assembly (5*a* and 6*a*) and crank shaft assembly (7) is a function of the geometrical parameters stroke length and bore ratio. Intuitively, a large bore to stroke ratio should result in smaller friction losses between the piston and cylinder. However, the larger piston diameter results in larger forces on the crankshaft (7) and thus, increased friction in the crankshaft bearing. These two competing effects must be balanced to find an optimum bore to stroke ratio.

The Friction Mean Effective Pressure is calculated as described by Patton equation for the crank shaft (7), FMEP is given by $$FMEP_{crank} = C1\frac{D_b}{B^2 S n_c} + C2\frac{N D_b^3 L_b n_b}{B^2 S n_c} + C3\frac{N^2 D_b^2 n_b}{n_c} \tag{7}$$

Here the first term denotes FMEP due to bearing seal friction, second term denotes FMEP due to main crank bearing and the third term is the FMEP due to turbulent dissipation of lubricant in the journal bearings.

And for the piston and connecting rod assembly, $$FMEP_{piston} = C4\frac{S_p}{B} + C2\frac{N D_b^3 L_b n_b}{B^2 S n_c} + C5\frac{1000 + N}{N B^2} \tag{8}$$

Here the first term gives FMEP due to sliding between piston and cylinder, assuming hydrodynamic lubrication. The second term accounts for turbulent dissipation and the third term is FMEP due to piston ring, assuming a mixture of hydrodynamic and boundary lubrication.

$D_b$ is the bearing diameter $L_b$ is the length of main bearing $n_b$ is the number of bearings $n_c$ is the number of cylinders

TABLE 3 empirical relations for FMEP model

| Expression | Value for Crank assembly | Value for piston assembly |
|---|---|---|
| $\frac{D_b}{B}$ | 0.6 | 0.57 |
| $\frac{L_b}{D_b}$ | 0.37 | 0.41 |
| $n_b$ | $1 + n_c$ | $1 + n_c$ |

TABLE 4 proportionality constants for FMEP model

| Constant | Value | Unit |
|---|---|---|
| $C_1$ | $1.22 \times 10^5$ | kPa -mm$^2$ |
| $C_2$ | $3.03 \times 10^{-4}$ | kPa -min/rev-mm |
| $C_3$ | $1.35 \times 10^{-10}$ | kPa -mm$^2$ |
| $C_4$ | 294 | kPa -mm - s/m |
| $C_5$ | $4.06 \times 10^4$ | kPa -mm$^2$ |

Figure 12:
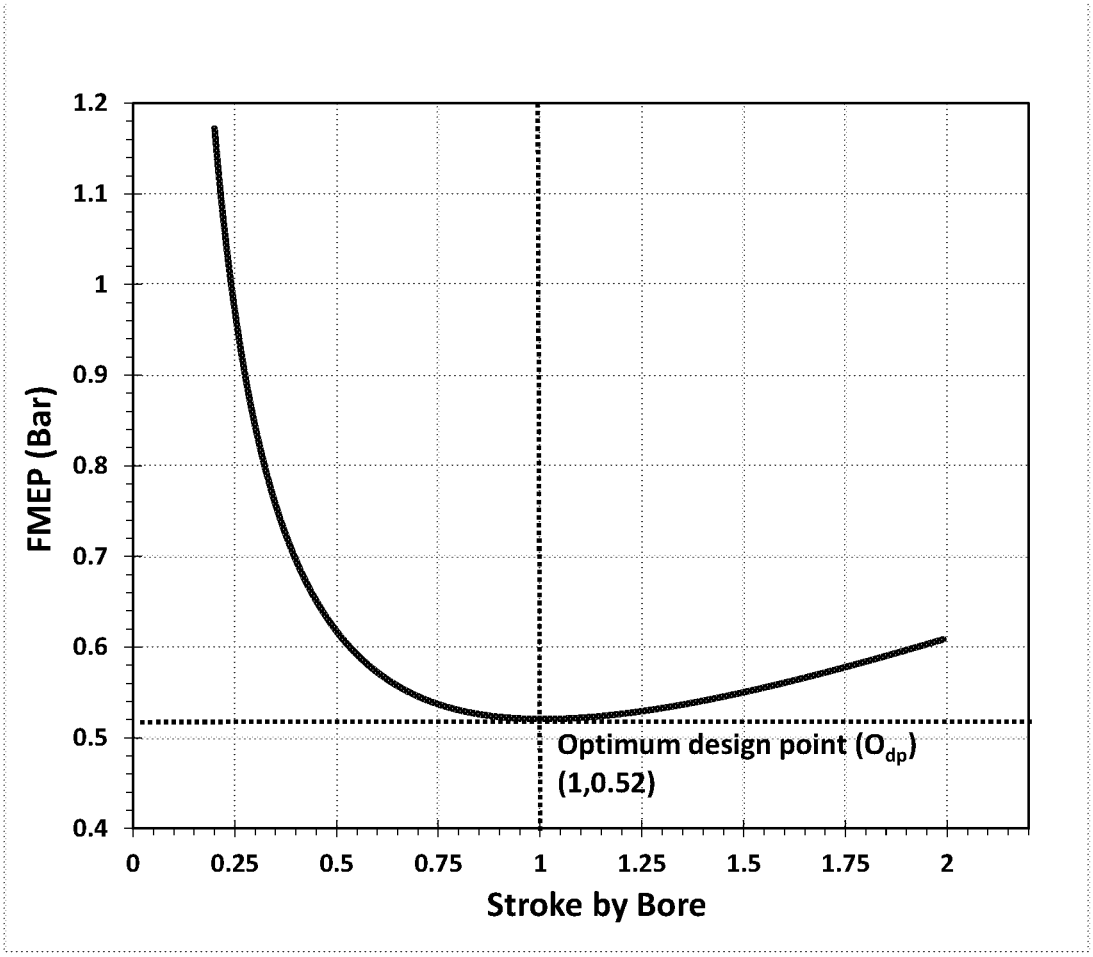
FIG. 12 shows a graph of frictional mean effective pressure v/s stroke by bore ratio for the expander cylinder, in accordance with an embodiment of the present disclosure.
Figure 13:
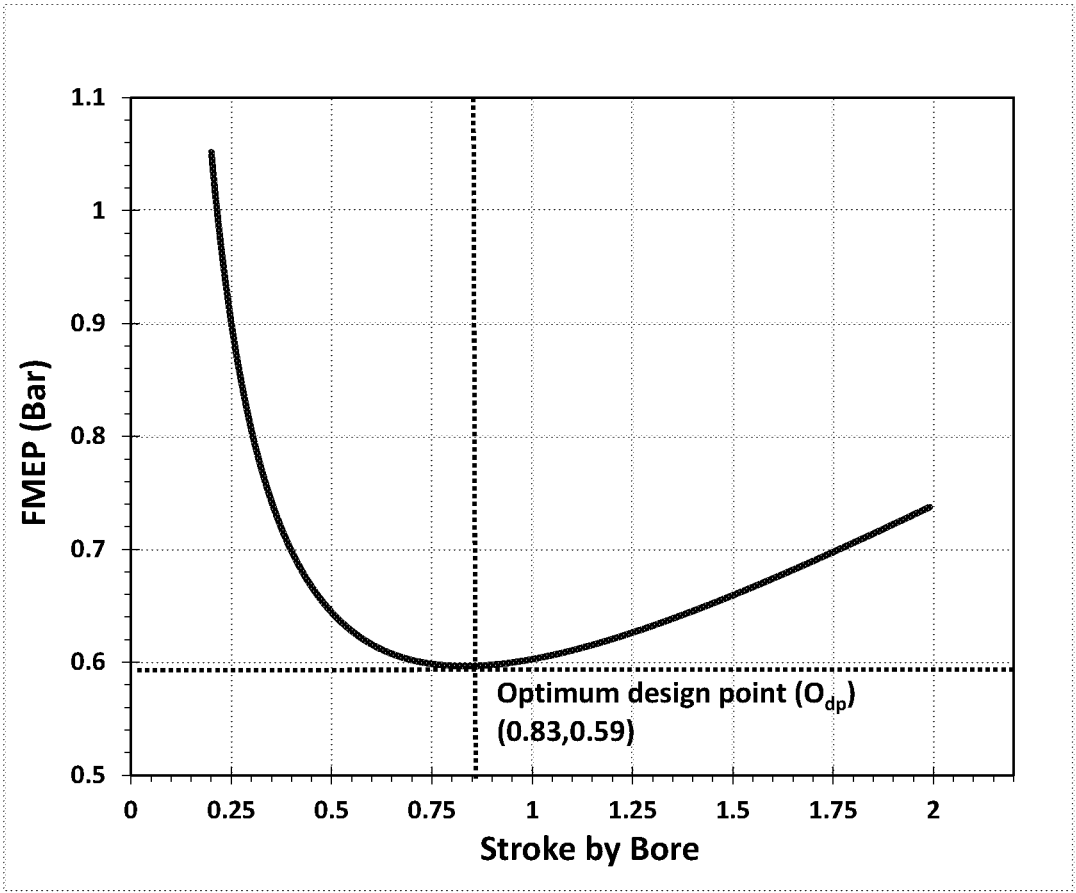
FIG. 13 shows a graph of frictional mean effective pressure vs stroke by bore ratio for the compression cylinder, in accordance with an embodiment of the present disclosure.

Effect of Stroke to bore ratio on FMEP is shown in FIGS. 12 and 13 for expander and compressor, respectively. The FMEP is calculated for given value of stroke to bore ration and the optimal stroke to bore ratio is chosen. As seen from the FIGS. 12 and 13, the point of the curve with minimal FMEP losses is chosen as the optimal stroke to bore ratio for the expansion and the compression cylinder (5 and 6). The corresponding values of the stroke to bore ratio and the values of stoke, bore diameter, clearance volume and swept volume are estimated and the same are indicated in the below table.

The optimized geometric parameters are given in the below table 5.

TABLE 5

| optimized geometric parameters | | |
|---|---|---|
| Parameter | Expander | compressor |
| Stroke to bore ratio | 1 | 0.83 |
| Stroke(mm) | 81 mm | 54 mm |
| Bore diameter(mm) | 81 mm | 65 mm |
| Clearance Volume(cc) | 60 | 50 |
| Swept Volume(cc) | 419 | 180 |

The step 202 for generating the cam profile is indicated below. Valve lift vs crank angle curves are generated for the compressor and expander.

$$x=L(1+C_2a^2+C_4a^4+C_pa^p+C_qa^q+C_ra^r+C_sa^s) \quad (3)$$

Here, L is maximum valve lift and x is valve lift $$a=\frac{|\theta-\theta_{max}|}{A} \quad (4)$$

Where θ is crank angle and $\theta_{max}$ is crank angle corresponding to maximum valve lift A is duration of half main event. p, q, r, s, $C_4$ are constants.

Table 5 describes the necessary inputs for Valve lift vs crank angle curve generation.

TABLE 5

| Inputs for generating cam profile | |
|---|---|
| Inlet diameter | 20(mm) |
| Max valve lift | 10(mm) |
| Half period (expander intake) | 45° |
| Half period (compressor intake) | 67° |
| Half period (expander exhaust) | 90° |
| Half period (compressor exhaust) | 38° |

Effect of valve lift on mass flow rate was considered and the thermodynamic cycles for compressor and expander were revised accordingly.

FIGS. 14 to 16 describe the real expander cycles. Initially, the first piston (5*a*) moves down from TDC as crankshaft (7) sweeps through an angle of 89°, $CO_2$ at 210 bar and 500° C. fills in the cylinder at constant pressure and temperature and the inlet valve (5*iv*) opens. The mass flow rate during the above intake stroke may range from 0 to 9 kg/s between the points 1 to 3 of the graph in FIG. 16. Further, between the points 3 to 4 in the FIGS. 14 to 16, both the inlet valve (5*iv*) and the outlet valve (5*ov*) are closed, and the $CO_2$ expands isentropically inside the expansion cylinder (5). Since the inlet valve (5*iv*) and the outlet valve (5*ov*) are closed, the mass flow rate during the expansion stroke or between the points 3 to 4 remains 0. Due to the isentropic expansion of $CO_2$, the first piston (5*a*) is pushed downwards, and the pressure drops to 90 bar with the temperature dropping to around 404° C. Further, after the end of the power stroke, the first piston (5*a*) begins to traverse from the BDC to the TDC of the expansion cylinder (5). As the first piston (5) traverses from DC to TDC, the exhaust valve (5*ev*) opens at a crank angle of around 180° C. and $CO_2$ is pushed out at constant temperature and pressure. The mass flow rate of the $CO_2$ flowing out of the exhaust cylinder (5) during the exhaust stroke may reach a peak of 5 kg/s and may eventually become 0 as the piston reaches the TDC at a crank angle of 360°. The $CO_2$ may be pushed out into the first $CO_2$ fluid line (Z1) through the exhaust port (5*e*) of the expansion cylinder (5).

FIGS. 17 to 19 describe the real compressor cycles. The points 5 to 6 indicate the downward movement of the piston as crank sweeps through an angle of 46°. The dead mass of $CO_2$ left in the clearance volume is expanded to avoid backflow and the mass flow rate remains negligible. The volume drops to around 90 cc and the pressure drops to 80 bar. Further, the inlet valve (6*i*) of the compression cylinder (6) opens around 230° of crank angle rotation and the $CO_2$ from the first $CO_2$ fluid line (Z1) begins to flow into the compression cylinder (5) through the inlet port (5*i*). the mass flow rate of $CO_2$ into the compression cylinder (5) is around 70 kg/s and the points 6 to 7 of the graph from FIGS. 17 to 19 indicate the intake stroke of the compression cylinder (6). The second piston (6*a*) traverses from the TDC to the BDC as the $CO_2$ fills up the compression cylinder (6) during the intake stroke at a constant pressure and temperature of 90 bar and 70° C. the mass flow rate during the intake stroke reaches to about 8 kg/s. Once, the second piston (6*a*) reaches the BDC at a crank angle of 360°, the inlet valve (6*iv*) closes. Further, the second piston (6*a*) moves towards the TDC as crankshaft (7) sweeps through an angle of 104° and the $CO_2$ is compressed from 90 bar to 210 bar. The temperature of $CO_2$ consequently, rises from 70° C. to 142° C. The curve between the points 7 and 8 in the graph from FIG. 17 indicates the isentropic compression of $CO_2$ inside the compression cylinder (6) and the mass flow rate remains 0 during this stage. The exhaust valve (6*ev*) opens at a crank angle of around 460° and as the piston traverses from the BDC to TDC during the compression stroke, the pressurized $CO_2$ is pushed out of the compression cylinder (6) into the second $CO_2$ flow line (Z2). The mass flow rate during the exhaust stroke reaches a peak of 16 kg/s and drops to 0 at the end of the exhaust strike. The exhaust valve (6*v*) remains open as the crankshaft (7) traverses an angle of 76°.

TABLE 6

| Summary of the results. | |
|---|---|
| Operating Frequency | 50 Hz |
| Power generated by expander | 155.2 kW |
| Power consumed by compressor | 71.25 kW |
| Friction losses in expander | 1.085 KW |
| Friction losses in expander | 0.53 kW |
| Net power generated | 82.3 kW |
| External heat given to system | 260.27 kW |
| Heat rejected | 163 kW |
| Heat recovered in recuperator | 435 kW |
| Cycle efficiency | 31.62% |

The above table illustrates the summary of results from the above calculations of idea and real cycle of compression and expansion cylinders (6 and 5) and the geometric optimization. FIG. 14 and FIG. 17 illustrate the ideal and real cycle for expansion and compression cylinder (5 and 6). The area within the plot of p-v diagram for the compressor (6) and the expander (5) may initially be calculated. This area is directly indicative of the work done by the expander (5) and the energy consumed by the compressor (6). To calculate the overall efficiency of the system, the frictional energy losses calculated above during geometric optimization and the energy consumed by the compressor (6) may be subtracted from the energy generated or the work done by the expander (5) and thereby further obtain the overall operation efficiency of the system. The overall cycle efficiency was found to be around 31%.

In an embodiment, the positive displacement system (100) is an ideal alternative for small volumetric flow rates encountered in sub-megawatt $sCO_2$ power generation.

In an embodiment, the operational efficiency of the system (100) of the present disclosure is around 31% and is a suitable replacement to Rankine based stem power plants.

Equivalents

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding the description may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, or drawings, should be understood to contemplate the possibilities of including one of the terms, either of the terms, or both terms. For example, the phrase "A or B" will be understood to include the possibilities of "A" or "B" or "A and B."

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated in the description.

REFERRAL NUMERALS

| Referral numerals | Description |
|---|---|
| C | First heat exchanger |
| C1 | First end of the first heat exchanger |
| C2 | Second end of the first heat exchanger |
| Cx | Coolant flow line |
| Z1 | First $CO_2$ flow line |
| Z2 | Second $CO_2$ flow line |
| 6 | Compressor/compression cylinder |
| 6a | Second piston |
| 6c | Second connecting rod |
| 6o | Compressor outlet |
| 6ov | Compressor outlet valve |
| 6i | Compressor inlet |
| 6iv | Compressor inlet valve |
| 7 | Crankshaft |
| 8 | Flywheel |
| 5 | Expander/expansion cylinder |
| 5a | First piston |
| 5c | First connecting rod |
| 5o | Expander outlet |
| 5ov | Expander outlet valve |
| 5i | Expander inlet |
| 5iv | Expander inlet valve |
| R | Third heat exchanger/recuperator |
| R1 | First end of the third heat exchanger |
| R2 | Second end of the third heat exchanger |
| H | Second heat exchanger |
| H1 | First end of the second heat exchanger |
| H2 | Second end of the second heat exchanger |
| Hx | Heating fluid line |

The invention claimed is:

1. A system for generating mechanical power using super critical carbon dioxide (sCO2), the system comprising:

at least one expansion cylinder (5) defining a first internal volume (V1), the expansion cylinder (5) houses a first piston (5*a*) connected to a crankshaft (7) through a first connecting rod (5*c*), wherein the expansion cylinder (5) is defined with one or more inlet ports (5*i*) and one or more outlet ports (5*o*);at least one compression cylinder (6) defining a second internal volume (V2), the compression cylinder (6) houses a second piston (6*a*) connected to the crankshaft (7) through a second connecting rod (6*c*), wherein the at least one compression cylinder (6) is defined with one or more inlet ports (6*i*) and one or more outlet ports (5*o*);

wherein the inlet ports (5*i*) of the at least one expansion cylinder (5) are each provided with one or more inlet valves (5*iv*) and the outlet ports (5*o*) of the at least one expansion cylinder (5) are each provided with one or more outlet valves (5*ov*);

wherein, the first internal volume (V1) of the at least one expansion cylinder (5) is greater than the second internal volume (V2) of the at least one compression cylinder (6);

a first heat exchanger (C) fluidically connected to the inlet ports (6*i*) of the at least one compression cylinder (6) and the outlet ports (60) of the at least one expansion cylinder (5);

a second heat exchanger (H) fluidically connected to the outlet ports (60) of the at least one compression cylinder (6) and the inlet ports (5*i*) of the at least one expansion cylinder (5); and a third heat exchanger (R) fluidly connecting the at least one compression cylinder (6) to the first heat exchanger (H) and the at least one expansion cylinder (5) to the second heat exchanger (C), wherein the inlet ports (5*i*) of the at least one expansion cylinder (5) are fluidly connected to a first end (HI) of the second heat exchanger (H) and the outlet ports (5*o*) of the expansion cylinder (5) are fluidically connected to a first end (R1) of the third heat exchanger (R);

wherein, the first heat exchanger (C) is configured to cool CO2 received from the outlet ports (So) of the at least one expansion cylinder (5), and the at least one compression cylinder (6) pressurizes the CO2 cooled by the first heat exchanger (C);

wherein, the second heat exchanger (H) is configured to heat the CO2 received from the outlet ports (6*o*) of the at least one compression cylinder (6) and supply to the inlet ports (Si) of the at least one expansion cylinder (5);

wherein, the third heat exchanger (R) is configured to recuperate heat from the CO2 received from the outlet ports (5*o*) of the at least one expansion cylinder (5) and supplied to the first heat exchanger;

wherein the inlet valves (5*iv*) of the at least one expansion cylinder (5) are configured to open when the first piston (5*a*) traverses down from a top dead center of the expansion cylinder (5) and the inlet valves (5*iv*) of the at least one expansion cylinder (5) are configured to close before the first piston (5*a*) is at a bottom dead center of the expansion cylinder (5);

wherein the outlet valves (5*ov*) of the at least one expansion cylinder (5) are configured to open when the first piston (5*a*) traverses from the bottom dead center of the expansion cylinder to the top dead center of the expansion cylinder (5) and the outlet valves (5*ov*) of the at least one expansion cylinder (5) are configured to close when the first piston (5*a*) is at the top dead center of the expansion cylinder (5); and high temperature and high-pressure CO2 drives the first piston (5*a*) housed inside the expansion cylinder (5) downwards to generate mechanical energy in the at least one expansion cylinder (5).

2. The system as claimed in claim 1, wherein the inlet ports (6*i*) of the at least one compression cylinder (6) are fluidically connected to a second end (C2) of the first heat exchanger (C) and the outlet ports (6*o*) of the at least one compression cylinder (6) are fluidically connected to a second end (R2) of the third heat exchanger (R).

3. The system as claimed in claim 1, wherein the inlet ports (6*i*) of the at least one compression cylinder (6) are each provided with one or more inlet valves (6*iv*) and the outlet ports (6*o*) of the at least one compression cylinder (6) are each provided with one or more outlet valves (6*ov*).

4. The system as claimed in claim 3, wherein the inlet valves (6*iv*) of the at least one compression cylinder (6) are configured to open when the second piston (6*a*) traverses down from a top dead center of the compression cylinder (6).

5. The system as claimed in claim 3, wherein the inlet valves (6*iv*) of the at least one compression cylinder (6) are configured to close when the second piston (6*a*) is at a bottom dead center of the compression cylinder (6).

6. The system as claimed in claim 3, wherein the outlet valves (6*ov*) of the at least one compression cylinder (6) are configured to open after pressurizing the CO2 and when the second piston (6*a*) traverses from a bottom dead center of the compression cylinder to a top dead center of the compression cylinder (6).

7. The system as claimed in claim 3, wherein the outlet valves (6*o*) of the at least one compression cylinder (6) are configured to close when the second piston (6*a*) reaches a top dead center of the compression cylinder (6).

8. A method of assembling a system for generating mechanical power using super critical carbon dioxide (sCO2), the method comprising of:

providing at least one expansion cylinder (5) defining a first internal volume (V1), the expansion cylinder (5) houses a first piston (5*a*) connected to a crankshaft (7) through a first connecting rod (5*c*), wherein the expansion cylinder (5) is defined with one or more inlet ports (5*i*) and one or more outlet ports (5*o*);

wherein the inlet ports (5*i*) of the at least one expansion cylinder (5) are each provided with one or more inlet valves (5*iv*) and the outlet ports (5*o*) of the at least one expansion cylinder (5) are each provided with one or more outlet valves (5*ov*);

providing at least one compression cylinder (6) defining a second internal volume (V2), the compression cylinder (6) houses a second piston (6*a*) connected to the crankshaft (7) through a second connecting rod (6*c*), wherein the at least one compression cylinder (6) is defined with one or more inlet ports (6*i*) and one or more outlet ports (5*o*);

wherein, the first internal volume (V1) of the at least one expansion cylinder (5) is greater than the second internal volume (V2) of the compression cylinder (6);

fluidically connecting a first heat exchanger (C) to the inlet ports (6*i*) of the at least one compression cylinder (6) and the outlet ports (6*o*) of the at least one expansion cylinder (5); and fluidically connecting a second heat exchanger (H) to the outlet ports (6*o*) of the at least one compression cylinder (6) and the inlet ports (5*i*) of the at least one expansion cylinder (5); and fluidically connecting a third heat exchanger (R) to the at least one compression cylinder (6) and the first heat exchanger (H) and the at least one expansion cylinder (5) to the second heat exchanger (C);

wherein the inlet ports (5*i*) of the at least one expansion cylinder (5) are fluidly connected to a first end (HI) of the second heat exchanger (H) and the outlet ports (5*o*) of the expansion cylinder (5) are fluidically connected to a first end (RI) of the third heat exchanger (R);

wherein, the first heat exchanger (C) is configured to cool CO2 received from the outlet ports (5*o*) of the at least one expansion cylinder (5), and the at least one compression cylinder (6) pressurizes the CO2 cooled by the first heat exchanger (C);

wherein, the second heat exchanger (H) is configured to heat the CO2 received from the outlet ports (6*o*) of the at least one compression cylinder (6) and supply to the inlet ports (5*i*) of the at least one expansion cylinder (5);

wherein, the third heat exchanger (R) is configured to recuperate heat from the CO2 received from the outlet ports (5*o*) of the at least one expansion cylinder (5) and supplied to the first heat exchanger;

wherein the inlet valves (5*iv*) of the at least one expansion cylinder (5) are configured to open when the first piston (5*a*) traverses down from a top dead center of the expansion cylinder (5) and the inlet valves (5*iv*) of the at least one expansion cylinder (5) are configured to close before the first piston (5*a*) is at a bottom dead center of the expansion cylinder (5);

wherein the outlet valves (5*ov*) of the at least one expansion cylinder (5) are configured to open when the first piston (5*a*) traverses from the bottom dead center of the expansion cylinder to the top dead center of the expansion cylinder (5) and the outlet valves (5*ov*) of the at least one expansion cylinder (5) are configured to close when the first piston (5*a*) is at the top dead center of the expansion cylinder (5): and high temperature and high-pressure CO2 drives the first piston (5*a*) housed inside the expansion cylinder (5) downwards to generate mechanical energy in the at least one expansion cylinder (5).

* * * * *